US011992048B2

(12) United States Patent
Kokadir

(10) Patent No.: US 11,992,048 B2
(45) Date of Patent: May 28, 2024

(54) CARTRIDGE WITH SEPARABLE COMPONENTS FOR THE EVAPORATION AND INHALATION OF A LIQUID MEDIUM

(71) Applicant: Sucipto Kokadir, Jarkata Barat (ID)

(72) Inventor: Sucipto Kokadir, Jarkata Barat (ID)

( * ) Notice: Subject to any disclaimer, the term of this patent is extended or adjusted under 35 U.S.C. 154(b) by 254 days.

(21) Appl. No.: 17/278,591

(22) PCT Filed: Feb. 12, 2020

(86) PCT No.: PCT/IB2020/051105
§ 371 (c)(1),
(2) Date: Mar. 22, 2021

(87) PCT Pub. No.: WO2021/044220
PCT Pub. Date: Mar. 11, 2021

(65) Prior Publication Data

US 2021/0352964 A1 Nov. 18, 2021

(30) Foreign Application Priority Data

Sep. 4, 2019 (ID) ..... S00201907767
Oct. 3, 2019 (ID) ..... S00201908739
Nov. 20, 2019 (ID) ..... P00201910704

(51) Int. Cl.
*A24F 40/42* (2020.01)
*A24F 40/10* (2020.01)
*A24F 40/485* (2020.01)

(52) U.S. Cl.
CPC ..... *A24F 40/42* (2020.01); *A24F 40/10* (2020.01); *A24F 40/485* (2020.01)

(58) Field of Classification Search
CPC ..... A24F 40/42; A24F 40/10; A24F 40/485
See application file for complete search history.

(56) References Cited

U.S. PATENT DOCUMENTS

| | | | | |
|---|---|---|---|---|
| 4,786,534 | A | 11/1988 | Aiken | |
| 6,938,394 | B2 | 9/2005 | Perell | |
| 9,986,769 | B1 | 6/2018 | Liu et al. | |
| 2016/0095356 | A1 | 4/2016 | Chan | |
| 2019/0297953 | A1* | 10/2019 | Qiu | A61M 11/042 |
| 2022/0167671 | A1* | 6/2022 | Zhou | A24F 40/485 |
| 2022/0354168 | A1* | 11/2022 | Stuart | A24F 40/42 |

FOREIGN PATENT DOCUMENTS

WO 2015179002 A2 11/2015

* cited by examiner

*Primary Examiner* — Travis S Chambers
(74) *Attorney, Agent, or Firm* — Judd M. Patton

(57) ABSTRACT

A cartridge which may comprise an atomization unit and a liquid tank which may be separate but configured to be joined together. The atomization unit and the liquid tank may each have one or more than one stabilizing connection between them and may be configured to be connected and stabilized by the stabilizing connections. The atomization unit may have one or more than one upper filling point, and the liquid tank may have one or more than one lower filling point. The union of the upper filling point and the lower filling point may result in fluid communication between the atomization unit and the liquid tank.

3 Claims, 23 Drawing Sheets

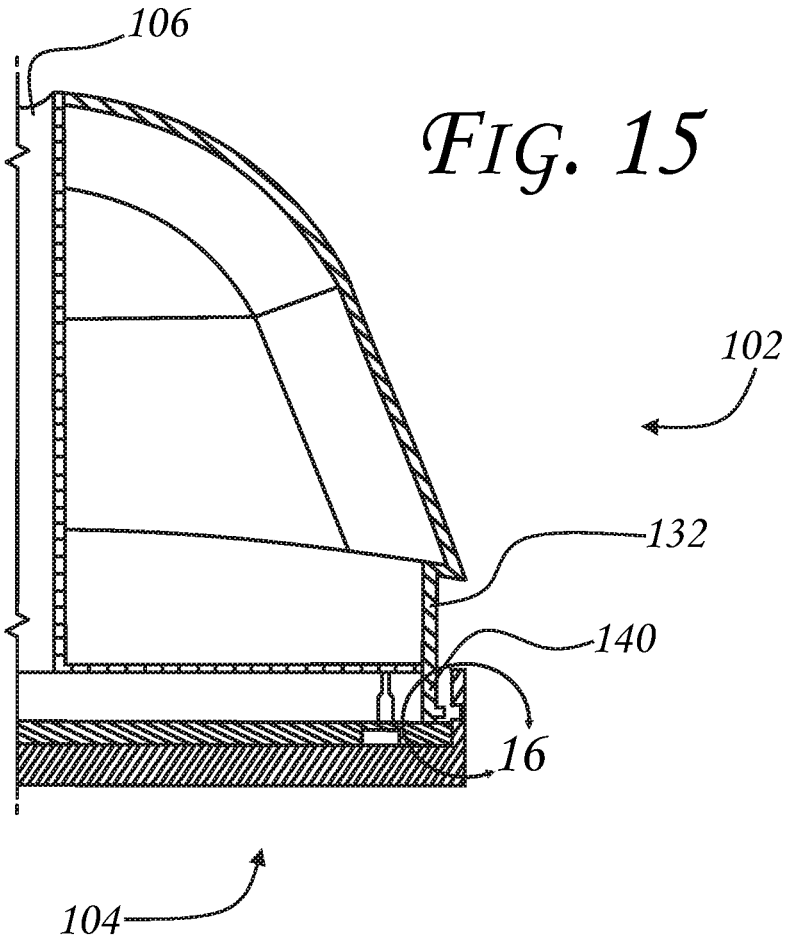
FIG. 15
FIG. 16
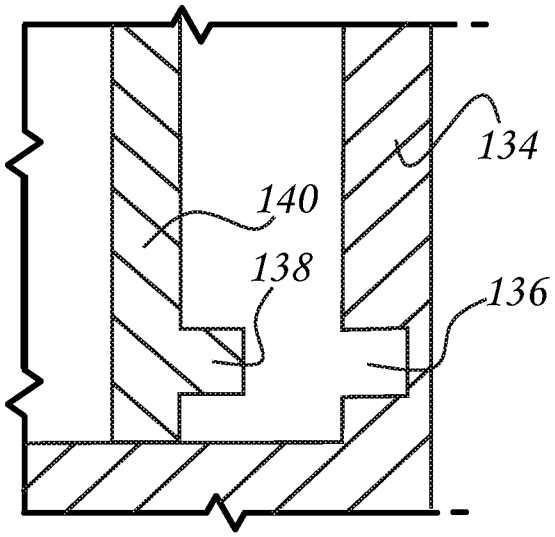

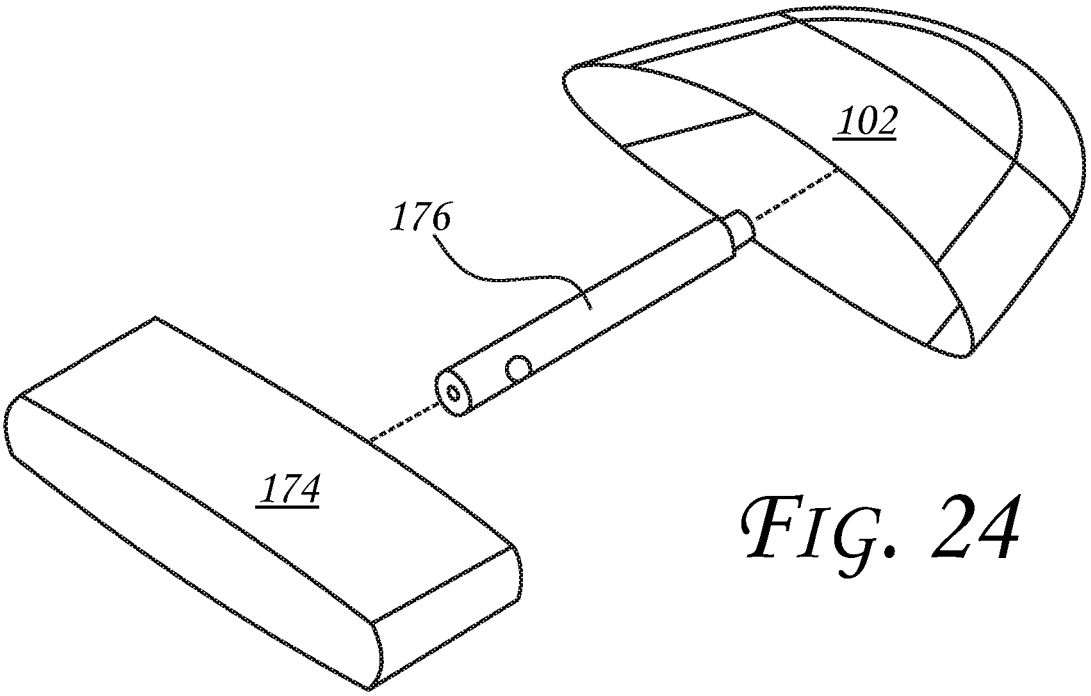
FIG. 24
FIG. 25
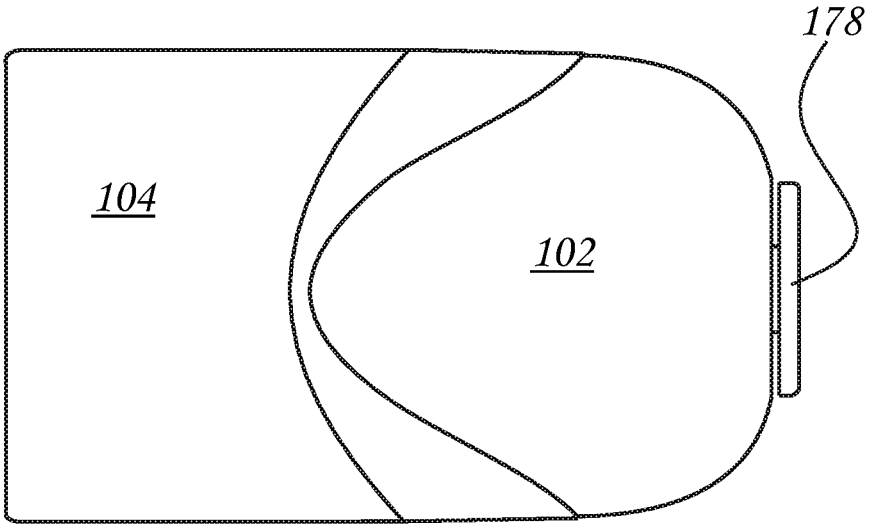

FIG. 29
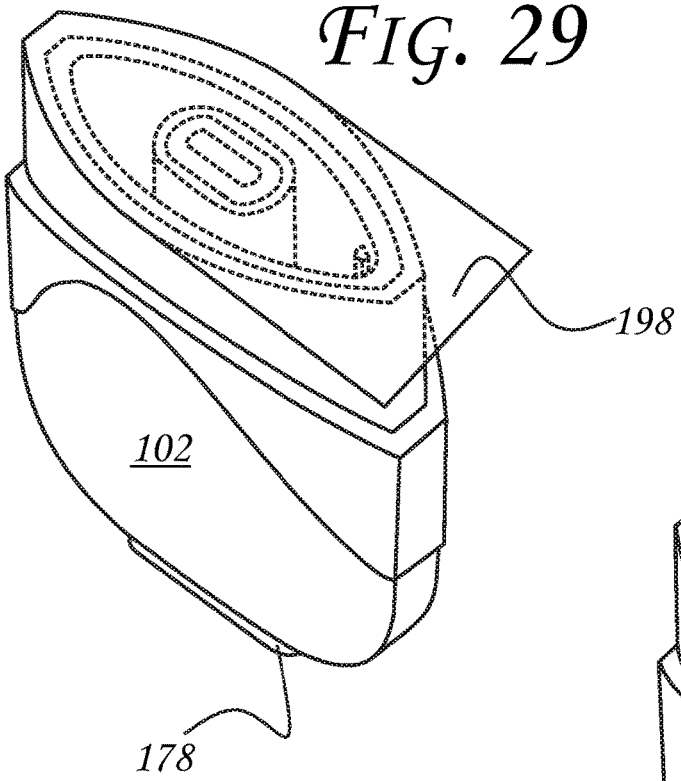
FIG. 30
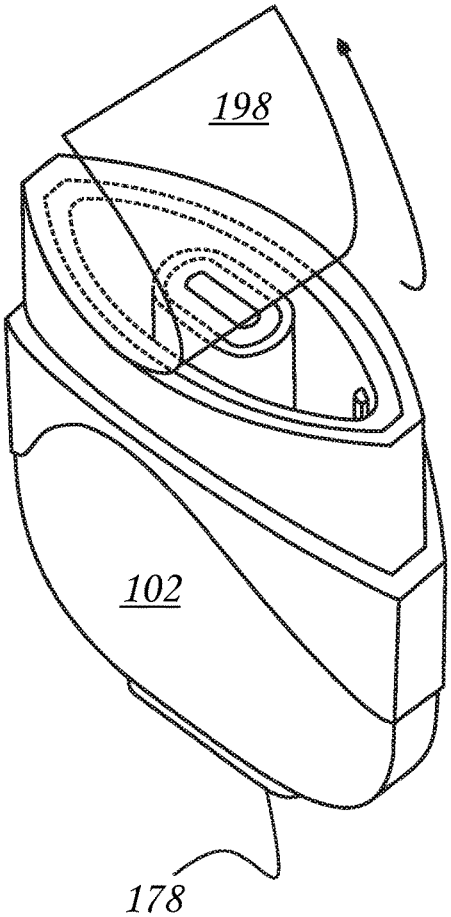
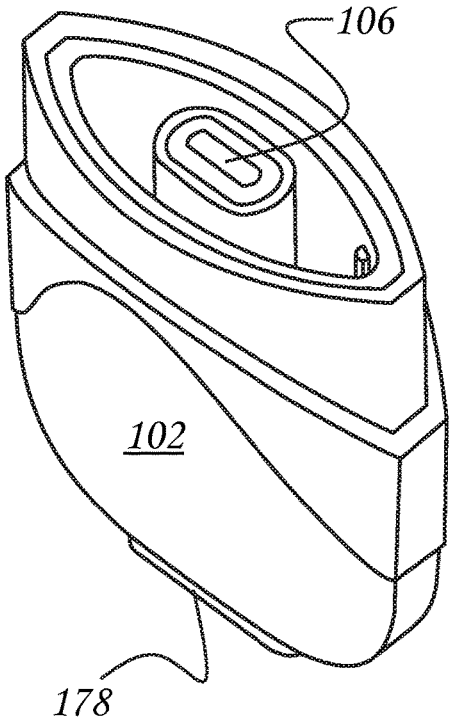
FIG. 31

CARTRIDGE WITH SEPARABLE COMPONENTS FOR THE EVAPORATION AND INHALATION OF A LIQUID MEDIUM

RELATED APPLICATIONS

This application is a U.S. national stage of PCT International Patent Application No. PCT/IB2020/051105, filed Feb. 12, 2020, which claims the benefit of Indonesian patent number S00201908739, filed Oct. 3, 2019; P00201910704, filed Nov. 20, 2019; and S00201907767, filed Sep. 4, 2019. All of the above-identified applications are incorporated by this reference in their entireties for all purposes as if fully set forth herein.

TECHNICAL FIELD

The disclosure herein relates generally to electronic cigarettes. More particularly this disclosure is related to a cartridge for use as an inhalator or evaporator that can also be used for medicinal or nicotine transfer. The cartridge on this as disclosed may facilitate logical segregation of the liquid contents of a cartridge from an atomizing element up to the moment of use by an end consumer. The separable parts could also be the upper cover, liquid tank, and atomization chamber.

BACKGROUND

Throughout history people have used and consumed tobacco and tobacco products. This has been encouraged by the tobacco industry through the presentation of advertisements that reflect a lifestyle in which tobacco use and consumption is normalized. Further, marketing coverage by the tobacco industry in addition to the social influence makes a combination strong enough to increase the number of smokers even in the face of seriously fatal diseases. This effect is broadly seen in populations of high tobacco consumption even though consumers of tobacco products understand the effects of tobacco and fully comprehend that nicotine is addictive. However, because conventional smoke has such significant effects on the users' health and the people around them, there is an increasing awareness which gives rise to a number of smokers who decide to stop smoking.

One answer to the endemic problems associated with tobacco consumption is that of individual and population-level transition to use of electronic cigarettes and the various other types of products as a replacement to conventional cigarettes and other plant-based tobacco products. This transitional process can and does result in smoking cessation. These several products, i.e., electronic cigarettes and other low-temperature smoke production devices, aid in mitigating the individual and population-level health problems because the products are not as dangerous as conventional plant-based smoke products.

Electronic cigarettes may use little or no nicotine, can be atomized into vapor, and are far less harmful to the users of the electronic cigarette than that of conventional tobacco products. The vapor can be inhaled by smokers the same as it is done with a conventional cigarette. A consequence of using electronic cigarettes is that smokers may control the nicotine which further aids in helping smokers quit smoking entirely by slowly becoming less addicted to nicotine. These products act as well as alternatives to conventional smoke the users' can and do find avenues to stopping their smoking habit entirely.

The electronic cigarettes currently available on the market usually consist of a few major components; including but not necessarily limited to a tank, a power bank, and an atomizer. The atomizer is used to produce vapor from a tobacco and nicotine liquid extract. This extract, as noted above, is the alternative nicotine source that is safer to the end consumer of tobacco products than the conventional plant-based smoke. This atomizer can also be used to produce vapor from other liquids that have a zero percent nicotine concentration, for example, herbal medicines, flavonoids, terpenes, or other natural plant-derived constituents. Accordingly, this means that these devices can also be used for medical purposes, or purposes other than nicotine delivery.

Commonly, when the tank and atomizer are sold and used as a single unit, the incorporated combination is referred to as a cartridge. The cartridge is often designed to be disposed of after a single-use. Consumers cannot refill single-use electronic cigarette cartridges with vaporizing liquid once all the liquid has been consumed, the entire device must be disposed of. This is unfortunate because although all hardware components are still functioning flawlessly and can be reused, the device is essentially useless without further addition of vaporizing liquid. This kind of design wastes considerable resources and places unnecessary financial burdens on the consumers and users of single-use electronic cigarettes. Refillable electronic cigarettes are also on the market which helps to abate this issue. However, these multi-use electronic cigarettes tend to be cumbersome to refill which results in spills and wasted vaporizing liquid.

What is needed is a cartridge with a separable liquid tank and atomization unit. The separable parts could also be the upper cover, liquid tank, and atomization chamber. Users of a cartridge with separable liquid tanks and atomization chambers could easily purchase only a pre-filled liquid tank and attach the tank to a more robust and reusable atomization unit. In such a design and system, the disposable part would only be a liquid tank which would thereby reduce the usage cost, total refuse volume, and the unnecessary financial burdens on the consumers and users of electronic cigarettes.

SUMMARY

Certain deficiencies of the prior art are overcome by the provision of embodiments of an apparatus, kit, and system in accordance with the present disclosure.

Certain embodiments of this disclosure may describe a combinable and separable cartridge which may have an atomization unit and a liquid tank which are separate from each other. The atomization unit may further have an atomization chamber, at least one lower filling point, and an atomizer engagement face. The liquid tank may further have a vapor duct, and at least one and possibly more than one an upper filling point, and a tank engagement face. The atomization unit may be prefilled with a liquid medium for use in vaporizing the e-liquid. The upper filling point of the liquid tank and the lower filling point of the atomization unit may be configured to mate together, wherein said mating of the upper filling point and the lower filling point may form a liquid permeable connection between the atomization unit 104 and the liquid tank 102 allowing the liquid medium to permeate from the liquid tank 102 to the atomization unit 104.

Other described embodiments may include a cartridge which may comprise an atomization unit and a liquid tank which may be separate but configured to be joined together.

The atomization unit and the liquid tank may each having one or more than one stabilizing connection between them and may be configured to be connected and stabilized by the stabilizing connections. Stabilizing connections are any connection that may provide a stabilizing force between the liquid tank and the atomization unit. The atomization unit may have one or more than one upper filling point, and the liquid tank may have one or more than one lower filling point. The union of the upper filling point and the lower filling point may result in fluid communication between the atomization unit and the liquid tank.

To achieve the stated purpose of overcoming deficiencies in the prior art, the cartridge in this disclosure may be divided into two parts, the liquid tank, and the atomization unit. The liquid tank and the atomization unit may be made separately and can be joined together to form a cartridge by an end-user of the cartridge. The liquid tank may have two main parts, the vapor duct, and the upper connection. The atomization unit may also have two parts, the atomization chamber, and the lower connection. Both the liquid tank and the atomization unit may have a filling point to flow the liquid from the tank into the atomization unit.

The liquid tank and the atomization unit may also allow the user to change the vapor flavor without needed to buy the whole cartridge which tends to be expensive. This feature can increase the comfortability of the user. Additionally, with only the liquid tank to be disposed of, the volume of waste will be reduced, thus making this design more environmentally friendly than the previous models available.

The connection between the liquid tank and the atomization unit as disclosed may be performed by a variety of methods, including but not limited to a clip type connection and friction connection. The clip connection may be divided into two parts, the inside clip and outside clip. An additional type of connection that can be considered is a clip connection that may become unitary with the filling point connection. The filling point connection in this disclosure may also be divided into two types, the filling connection with lift-valve like mechanism, and the filling connection with lock mechanism. The cartridge could also have an alternative model wherein the separable parts may be the upper cover, liquid tank, and atomization chamber.

BRIEF DESCRIPTION OF THE DRAWINGS

The foregoing and other features of the present disclosure will become more fully apparent from the following description, taken in conjunction with the accompanying drawings. Understanding that these drawings depict only several embodiments in accordance with the disclosure and are not to be considered limiting of its scope, the disclosure will be described with additional specificity and detail through the use of accompanying drawings. Accordingly, further advantages of the present invention may become apparent to those skilled in the art with the benefit of the following detailed description of the preferred embodiments and upon reference to the accompanying drawings in which:

FIG. 15 is a cross-sectional view of an apparatus in accordance with one non-limiting embodiment of a vaporizing cartridge wherein the liquid tank and atomizer are illustrated in one potential clipping configuration;

FIG. 16 is a cross-sectional view of an apparatus in accordance with one non-limiting embodiment of a vaporizing cartridge wherein the liquid tank and atomizer are illustrated in one potential clipping configuration;

FIG. 24 is a perspective exploded view of one alternative and non-limiting embodiment of a vaporizing cartridge of a liquid tank and atomizer for facilitating vaporization of various liquid mediums;

FIG. 25 is a plan view of an apparatus in accordance with one alternate non-limiting embodiment of a vaporizing cartridge wherein the liquid tank and atomizer for facilitating vaporization of various liquid mediums containing nicotine or pharmaceuticals have been placed into a coupled configuration;

FIG. 29 is a perspective view of an apparatus in accordance with one alternate non-limiting embodiment of a vaporizing cartridge wherein the liquid tank and atomizer are illustrated in a decoupled configuration and a membrane separator is further illustrated as fully in place;

FIG. 30 is a perspective view of an apparatus in accordance with one alternate non-limiting embodiment of a vaporizing cartridge wherein the liquid tank and atomizer are illustrated in a decoupled configuration and a membrane separator is further illustrated as partially in place;

FIG. 31 is a perspective view of an apparatus in accordance with one alternate non-limiting embodiment of a vaporizing cartridge wherein the liquid tank and atomizer are illustrated in a decoupled configuration and a membrane separator has been removed in its entirety;

DETAILED DESCRIPTION OF THE PREFERRED EMBODIMENTS

Figure 1:
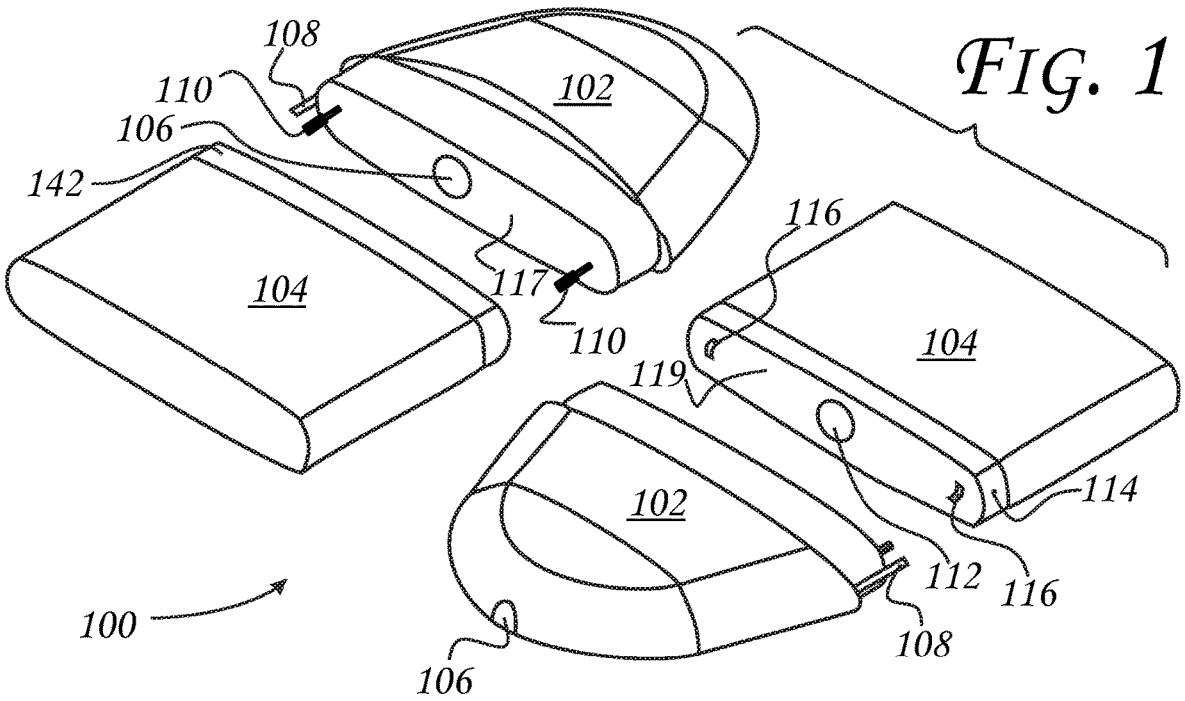
FIG. 1 is a perspective view of an apparatus (device) in accordance with one non-limiting embodiment of a vaporizing cartridge with liquid tank and atomizer for facilitating vaporization of various liquid mediums containing nicotine or pharmaceuticals.

Embodiments of systems, components, and methods of assembly and manufacture will now be described with reference to the accompanying figures. Although several embodiments, examples, and illustrations are disclosed below, it will be understood by those of ordinary skill in the art that the embodiments described herein extend beyond the specifically disclosed configurations, examples, and illustrations, and can include other users of the disclosure and obvious modifications and equivalents thereof. The terminology used in the descriptions presented herein is not intended to be interpreted in any limited or restrictive manner simply because it is being used in conjunction with a detailed description of certain specific embodiments of the disclosure. In addition, embodiments of the disclosure can comprise several novel features and no single feature is solely responsible for its desirable attributes or is essential to practicing any one of the several embodiments herein described.

Certain terminology may be used in the following description for the purpose of reference only, and thus are not intended to be limiting. For example, terms such as "above" and "below" refer to directions in the drawings to which reference is made. Terms such as "front," "back," "left," "right," "rear," "top," "bottom" and "side" describe the orientation and/or location of portions of the components or elements within a consistent but arbitrary frame of reference which is made clear by reference to the text and the associated drawings describing the components or elements under discussion. Moreover, terms such as "first," "second," "third," and so on may be used to describe separate components. Such terminology may include the words specially mentioned above, derivatives thereof, and words of similar import.

Referring to the drawings, like reference numerals designate identical or corresponding features throughout the several views. Described herein are certain non-limiting embodiments of a cartridge 100 for use in the application and support of medical vaporization, nicotine vaporization, smoking cessation, electronic liquid vaporization, or flavor enjoyment thereof.

This disclosure may be designed as cartridge 100 for use with the inhalation via the atomization, and/or vaporization, of an electronic vaporization liquid medium (hereinafter "e-liquid") which can be used to deliver medicine or nicotine and which may include a separable liquid tank 102 from an atomization unit 104. This invention may be considered more environmentally friendly because the liquid tank 102 may be the only readily disposed component. Accordingly, the separation of the liquid tank 102 and the atomization unit 104 may help reduce usage cost because the liquid tank 102 may only need replacing when e-liquid requires replenishing.

The liquid tank 102 of this disclosure may have three components including, but not limited to, a vapor duct 106, an upper connection 108, and an upper filling point 110. The atomization unit 104 may also have three components which may include the atomization chamber 112, the lower connection 114, and the lower filling point 116. The vapor produced in the atomization unit 104 may be flowed through the atomization chamber 112 into the vapor duct 106 before inhalation by the users. The liquid tank 102 and the atomization unit 104 may be connected through the upper connection 108 and lower connection 114. The liquid on the liquid tank 102 may flow into the atomization unit 104 through the connection of upper filling point 110 and lower filling point 116. It should be specifically noted that FIGS. 1 through 6, 8, and 9, show the cartridge 100 at a perspective view with an approximate 180 degree axial rotation between the left and right images. The axis of rotation can be defined as an imaginary line that begins at the vapor duct 106 and heads in a straight line to the atomization unit 104 and out the end. FIG. 7 shows a similar type of axial rotation, but the rotation is not a complete or approximate 180 degrees. Additional rotation of approximately 180 degrees is also performed along a line which may be defined by the empty space between the atomization unit 104 and the liquid tank 102. Thus reference numbers used for a left image are understood to be inherent in the right image and vice versa.

Referring now to FIG. 1, shown is the liquid tank 102 and atomization unit 104 with one upper connection 108 and lower connection 114 which may be located to one edge of the liquid tank 102. The connection of the upper connection 108 and lower connection 114 may be considered a supportive junction and is well illustrated in the engaged configuration of FIGS. 11, 13, 15, and 17. A supportive junction may be defined as a point of contact between the liquid tank 102 and atomization unit 104 wherein the contact provides a stabilizing and joining effect for the union of the liquid tank 102 and the atomization unit 104. There are many varieties of supportive junctions located throughout this application, each may occur with different terms for the specific parts providing the support, but will nonetheless be considered a supportive junction under this definition. Additionally, terms such as support connection, supportive connection, stabilizing junction, stabilizing point, support point, support, securement junction, securement point, and but not limited to junction, will fall under the same definitional understanding as a supportive junction in either the singular or plural form.

The particular embodiment illustrated in FIG. 1 may have one supportive junction which may support both the weight of the atomization unit 104 and the cartridge 100 generally. However, other support points are contemplated both in differing singular locations and in multiplicity as may be described in this disclosure and this single support point may be sufficient. Of further note regarding the connection of the upper connection 108 and the lower connection 114 is the respective faces, the tank engagement face 117 and the atomizer engagement face 119, wherein additional contact is made between the liquid tank 102 and atomization unit 104. As shown, the atomization unit 104 may have a respective atomizer engagement face 119 and the liquid tank 102 may have a respective tank engagement face 117. Accordingly, there are numerous potential embodiments for both the atomizer engagement face 119 and the tank engagement face 117 as will be discussed in greater detail throughout this disclosure.

Various alternative embodiments of the cartridge 100 will be disclosed and it should be noted that each embodiment may be well suited to align the upper filling point 110 and the lower filling point 116 for proper e-liquid transfer. Accordingly, it is a critical aspect of this disclosure that e-liquid be maintained in the liquid tank 102 exclusively until the mating of the tank engagement face 117 and the atomizer engagement face 119 occur thereby aligning the upper filling point 110 with the lower filling point 116. Only after this alignment and mating occur may e-liquid pass from the liquid tank 102 to the atomization unit 104.

Figure 2:
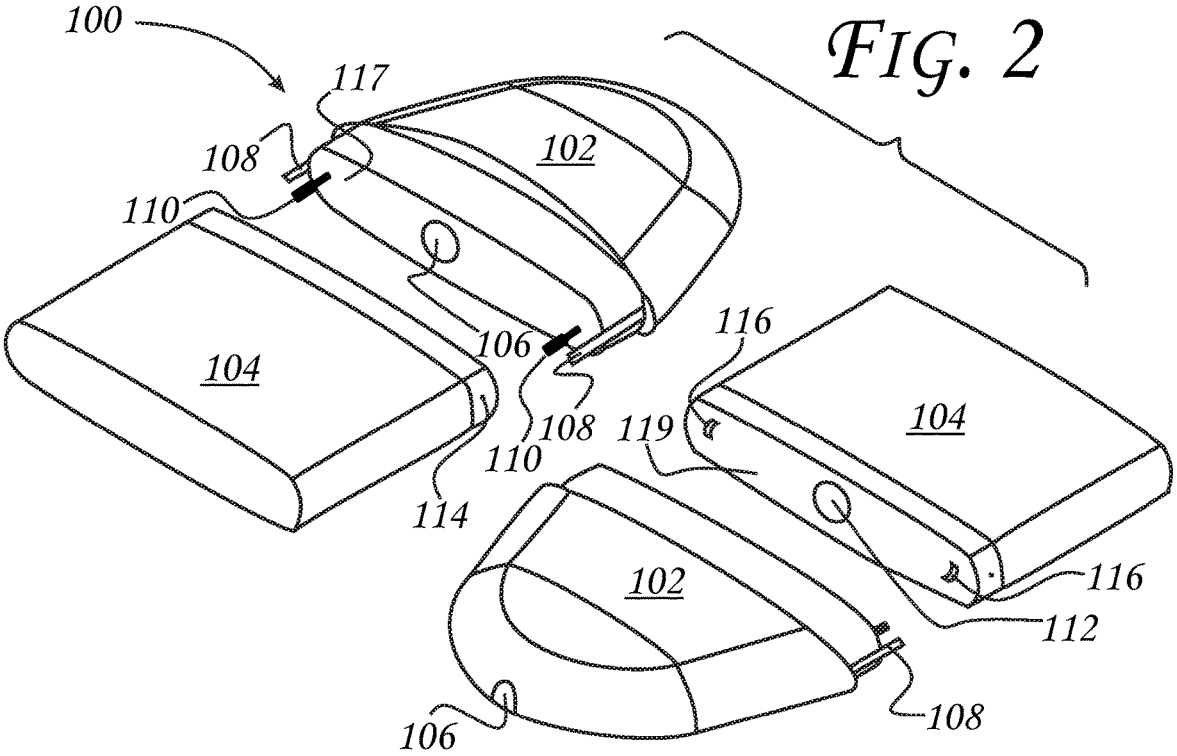
FIG. 2 is a perspective view of an apparatus in accordance with one non-limiting embodiment of a vaporizing cartridge with liquid tank and atomizer for facilitating vaporization of various liquid mediums containing nicotine or pharmaceuticals, wherein additional connection junctions are illustrated.

Referring now to FIG. 2, shown is an embodiment of the cartridge 100 wherein the liquid tank 102 and atomization unit 104 have an upper connection 108 and lower connection 114 located on more than one edge. The embodiment shown in FIG. 2 may be illustrative of the versatility of the potential selections for supportive junctions wherein the two support points used to support the weight of the atomization unit 104 and liquid tank 102 to form the cartridge 100 may be beneficial, but not strictly necessary, for the stated purpose and well suited to align the upper filling point 110 and the lower filling point 116 for proper e-liquid transfer.

Figure 3:
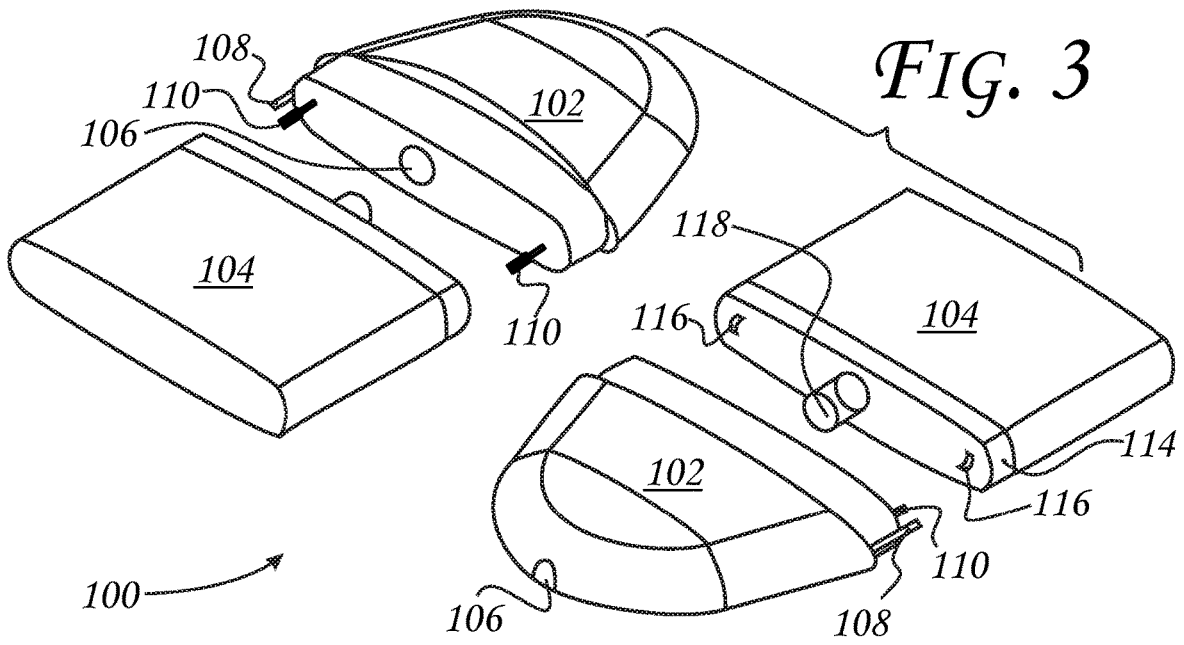
FIG. 3 is a perspective view of an apparatus in accordance with one non-limiting embodiment of a vaporizing cartridge with liquid tank and atomizer for facilitating vaporization of various liquid mediums containing nicotine or pharmaceuticals, wherein a protruding atomization chamber is illustrated.

Referring now to FIG. 3 shown is an embodiment of the cartridge 100 wherein the liquid tank 102 and atomization unit 104 have been illustrated with an upper connection 108 and lower connection 114 located on one of the edges. Further, there is an additional supportive junction at a point in the middle which is formed by a protrusion of an atomization protrusion 118 from the atomization chamber 112 (shown in FIG. 1) which may be aligned to enter the vapor duct 106. Accordingly, this embodiment may have two supportive junctions to support the weight of the atomization unit 104, liquid tank 102, and more generally the cartridge 100 as a whole. The embodiment as shown in FIG. 3 may illustrative of the versatility of the potential selections for supportive junctions wherein the two support points to support the weight of the atomization unit 104 as coupled to the liquid tank 102 to form the cartridge 100 generally. Such a configuration may be beneficial, but not strictly necessary, for the stated purpose and well suited to align the upper filling point 110 and the lower filling point 116 for proper e-liquid transfer.

Figure 4:
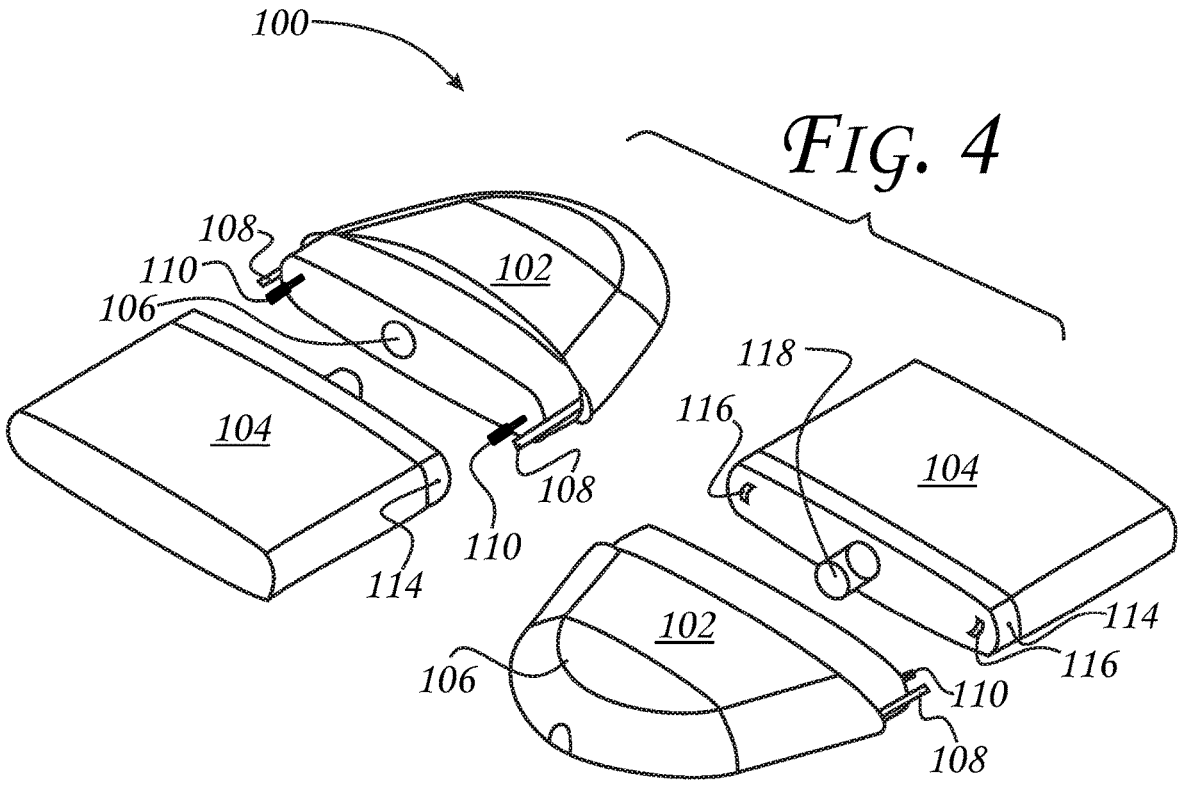
FIG. 4 is a perspective view of an apparatus in accordance with one non-limiting embodiment of a vaporizing cartridge with liquid tank and atomizer for facilitating vaporization of various liquid mediums containing nicotine or pharmaceuticals, wherein an additional view and embodiment of a protruding atomization chamber is illustrated.

Referring now to FIG. 4 shown is an embodiment of the cartridge 100 wherein the liquid tank 102 and atomization unit 104 have been illustrated with an upper connection 108 and lower connection 114 located on more than one edge. Further, there is an additional supportive junction at a point in the middle which is formed by a protrusion of the atomization protrusion 118 from the atomization chamber 112 which may be aligned to enter the vapor duct 106. Accordingly, this embodiment may have three supportive junctions to support the weight of the atomization unit 104, liquid tank 102, and more broadly speaking cartridge 100 as a whole. The embodiment shown in FIG. 4 may be illustrative of the versatility of the potential selections for supportive junctions wherein the three support points to support the weight of the atomization unit 104 as coupled to the liquid tank 102 thereby forming the cartridge 100 generally. Such a configuration may be beneficial, but not strictly necessary, for the stated purpose and well suited to align the upper filling point 110 and the lower filling point 116 for proper e-liquid transfer.

Figure 5:
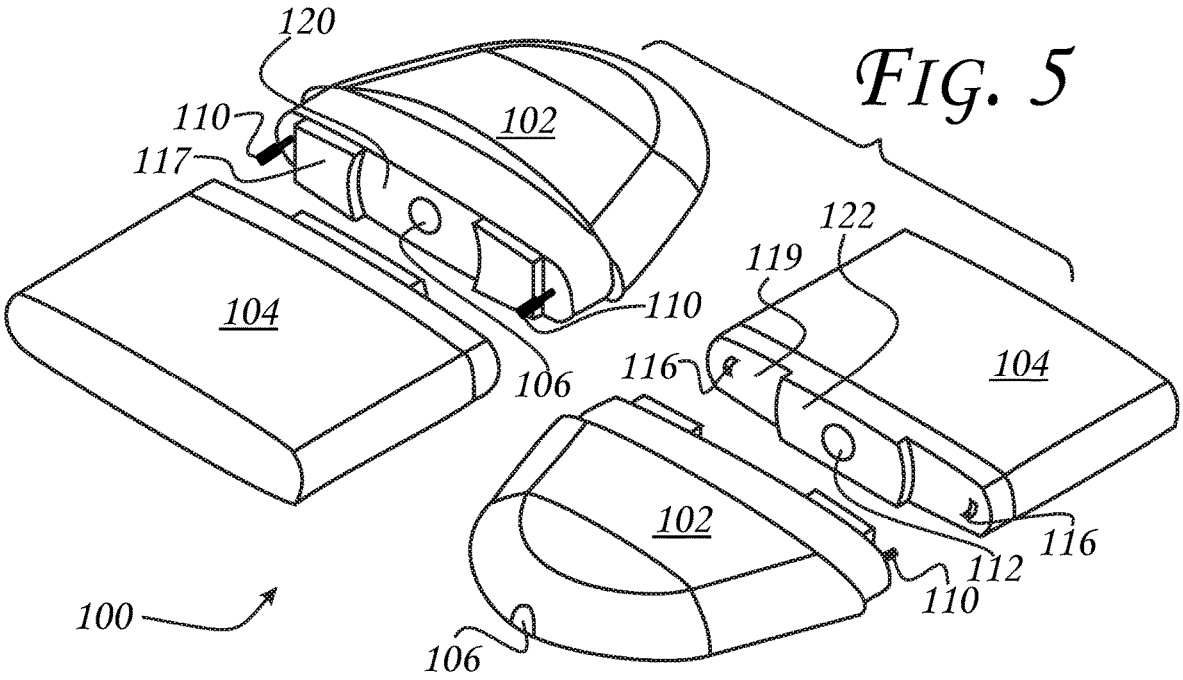
FIG. 5 is a perspective view of an apparatus in accordance with one non-limiting embodiment of a vaporizing cartridge with liquid tank and atomizer for facilitating vaporization of various liquid mediums containing nicotine or pharmaceuticals, wherein a clasped connection junction is illustrated.

Referring now to FIG. 5, shown is one embodiment of the cartridge 100 wherein the liquid tank 102 and atomization unit 104 may have a variation of the respective tank engagement face 117 and atomizer engagement face 119. Accordingly, the liquid tank 102 may have a tank engagement face 117 with an additional face recess 120 which is recessed into the tank engagement face 117. The atomization unit 104 may have an atomizer engagement face 119 which may have an additional face protrusion 122 which may protrude from the atomizer engagement face 119. The face recess 120 of the tank engagement face 117 may fit with the face protrusion 122 of the atomizer engagement face 119 much like a hand into a glove (not shown). With the additional fit of the face protrusion 122 and the face recess 120, this particular area may be considered to be an additional securement point for connection and stability and may act very much as the upper connection 108 and lower connection 114 as illustrated in FIGS. 1 and 2. The supportive junction and connection on the middle of the atomizer engagement face 119 by the face protrusion 122 and the tank engagement face 117 by the face recess 120 may well be assisted by a clasping effect of the face protrusion 122 as it is inserted into the face recess 120 preventing lateral movement of the liquid tank 102 with respect to the atomization unit 104. Prevention of lateral movement may permit a proper connection between the upper filling point 110 and the lower filling point 116. Accordingly, this particular embodiment may only have one support point to support the weight and restrict the motion of the atomization unit 104 relative to the assembled cartridge 100. The embodiment as shown in FIG. 5 may be illustrative of the versatility of the potential embodiments for supportive junctions wherein the single support point illustrated may adequately support the weight of the atomization unit 104 as it is coupled to the liquid tank 102 to form the cartridge 100 generally. Such a configuration may be beneficial, but not strictly necessary, for the stated purpose.

Figure 6:
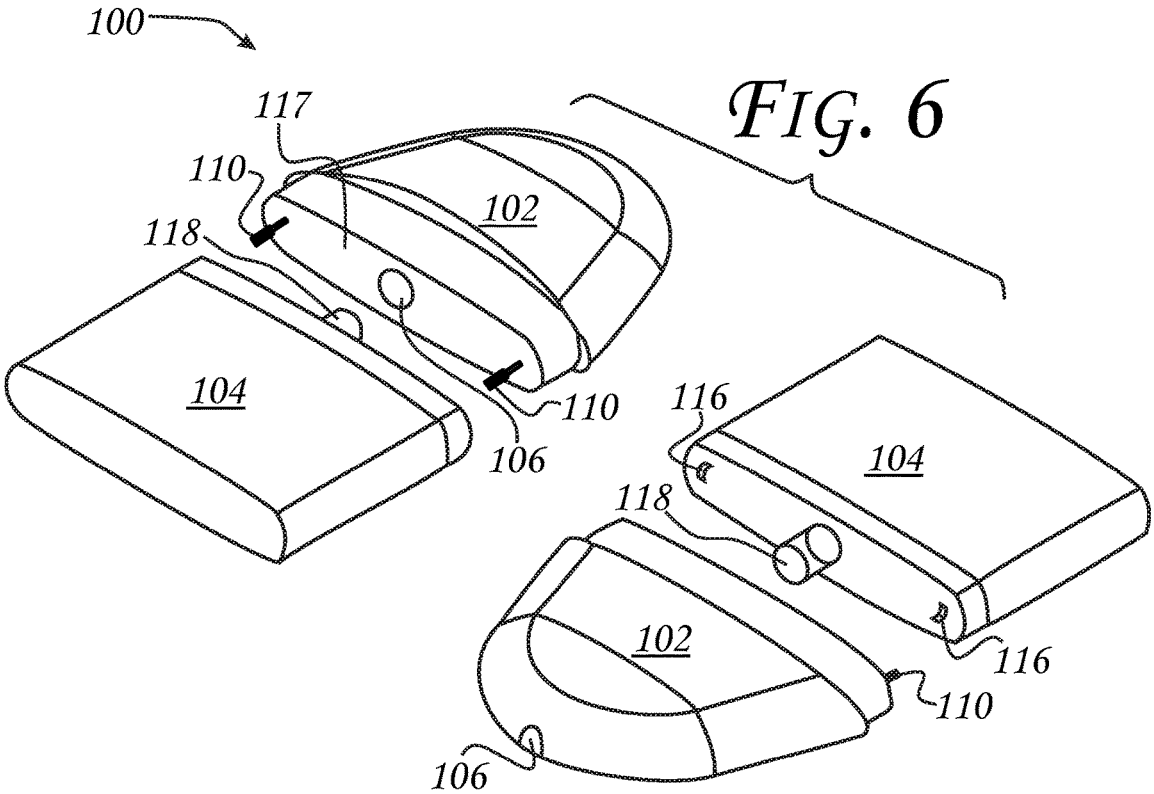
FIG. 6 is a perspective view of an apparatus in accordance with one non-limiting embodiment of a vaporizing cartridge with liquid tank and atomizer for facilitating vaporization of various liquid mediums containing nicotine or pharmaceuticals, wherein alternative embodiments of connection junctions and protruding atomization chamber are illustrated.
Figure 7:
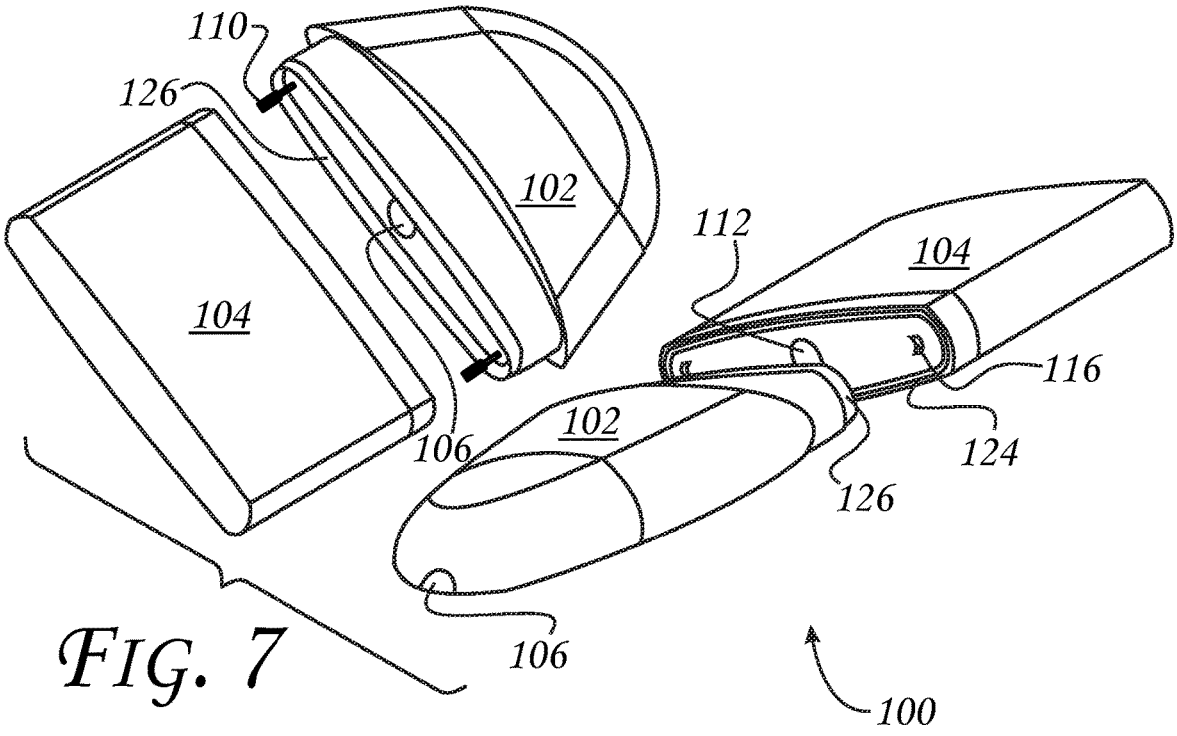
FIG. 7 is a perspective view of an apparatus in accordance with one non-limiting embodiment of a vaporizing cartridge with liquid tank and atomizer for facilitating vaporization of various liquid mediums containing nicotine or pharmaceuticals, wherein a ring slot connection is illustrated.

Referring now to FIG. 6, shown is an embodiment of the cartridge 100 wherein the liquid tank 102 and atomization unit 104 may join together the tank engagement face 117 and atomizer engagement face 119. This figure illustrates a singular stabilizing junction and connection wherein the atomization protrusion 118 provides stability against lateral movement of the liquid tank 102 with respect to the atomization unit 104 due to insertion and mating with the vapor duct 106. The embodiment still includes proper alignment for fluid flow between the upper filling point 110 and the lower filling point 116. Accordingly, this model has only one support point to support the weight of the atomization unit 104, the liquid tank 102, and generally speaking the cartridge 100. The embodiment shown in FIG. 6 may be illustrative of the versatility of the potential selections for supportive junctions wherein only one support point is needed to support the weight of the atomization unit 104 as coupled with the liquid tank 102 to form the cartridge 100 generally which may be sufficient for the stated purpose and well suited to align the upper filling point 110 and the lower filling point 116 for proper e-liquid transfer.

Referring now to FIG. 7, shown is an embodiment of the cartridge 100 wherein the liquid tank 102 and atomization unit 104 are joined the supportive junction is developed by way of a circumferential engagement slot 124 disposed on the atomization unit 104 and having a female configuration. The circumferential engagement slot 124 may be designed to circumferentially envelop a circumferential engagement member 126 which may be located on the liquid tank 102. Accordingly, the circumferential engagement member 126 may have a male configuration and be designed to rest internally to the circumferential engagement slot 124 and may be considered a supportive junction. The embodiment as shown in FIG. 7 may be illustrative of the versatility of the potential embodiments for supportive junctions where in this particular embodiment may have one circumferential support point to support the weight of the atomization unit 104 in combination with the liquid tank 102 to form the cartridge 100 generally. Such a configuration may be sufficient for the stated purpose and well suited to align the upper filling point 110 and the lower filling point 116 for proper e-liquid transfer.

Figure 8:
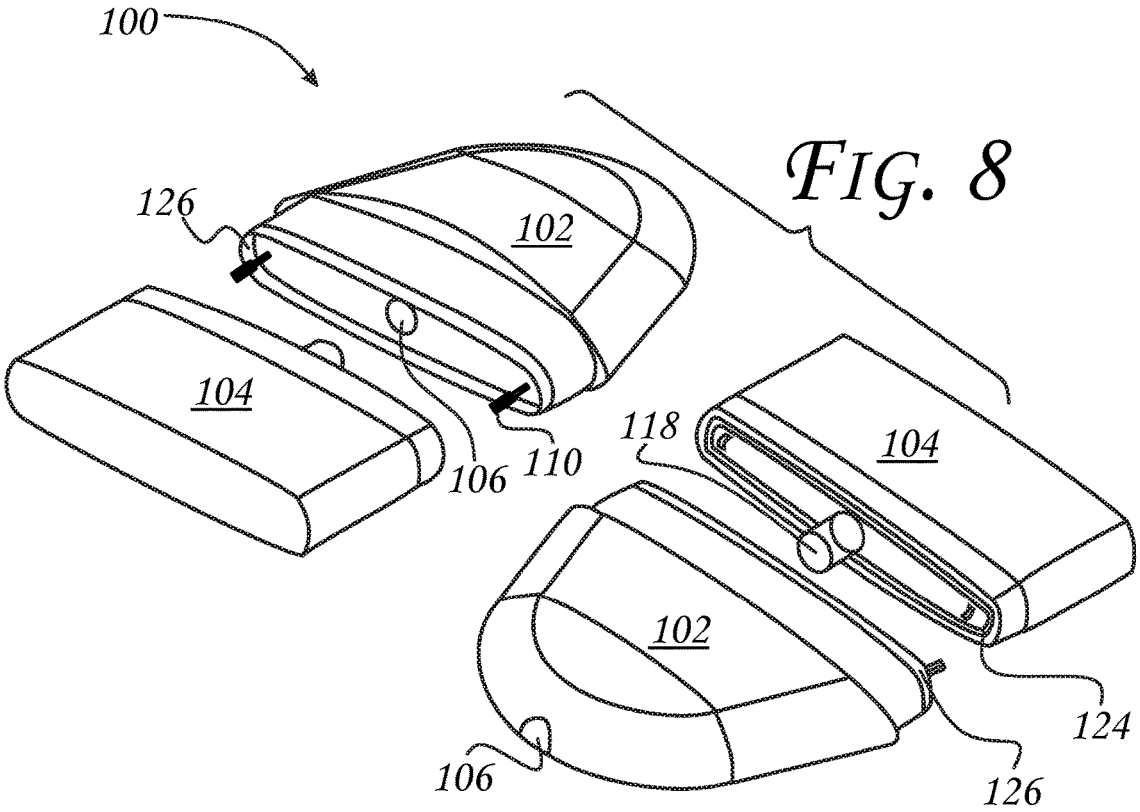
FIG. 8 is a perspective view of an apparatus in accordance with one non-limiting embodiment of a vaporizing cartridge with liquid tank and atomizer for facilitating vaporization of various liquid mediums containing nicotine or pharmaceuticals, wherein a ring slot connection and protruding atomization chamber are illustrated.

FIG. 8 shows an alternative embodiment to the above-discussed FIG. 7 wherein the supportive junction is developed by way of a circumferential engagement slot 124 and a circumferential engagement member 126. Additionally, the embodiment illustrated in FIG. 8 shows that the use of the atomization protrusion 118 may be used in conjunction with the circumferential type engagement means. The atomization protrusion 118 may mate and align with the vapor duct 106 thereby preventing any lateral movement of the liquid tank 102 with respect to the atomization unit 104 when joined in a unit to form the cartridge 100. The embodiment shown in FIG. 8 may be illustrative of the versatility of the potential embodiments for supportive junctions where in this particular embodiment may have two support points, wherein one support point is circumferential in design, to support the weight of the atomization unit 104 in combination with the liquid tank 102 to form the cartridge 100 generally. Such a configuration may be sufficient for the stated purpose and well suited to align the upper filling point 110 and the lower filling point 116 for proper e-liquid transfer.

Figure 9:
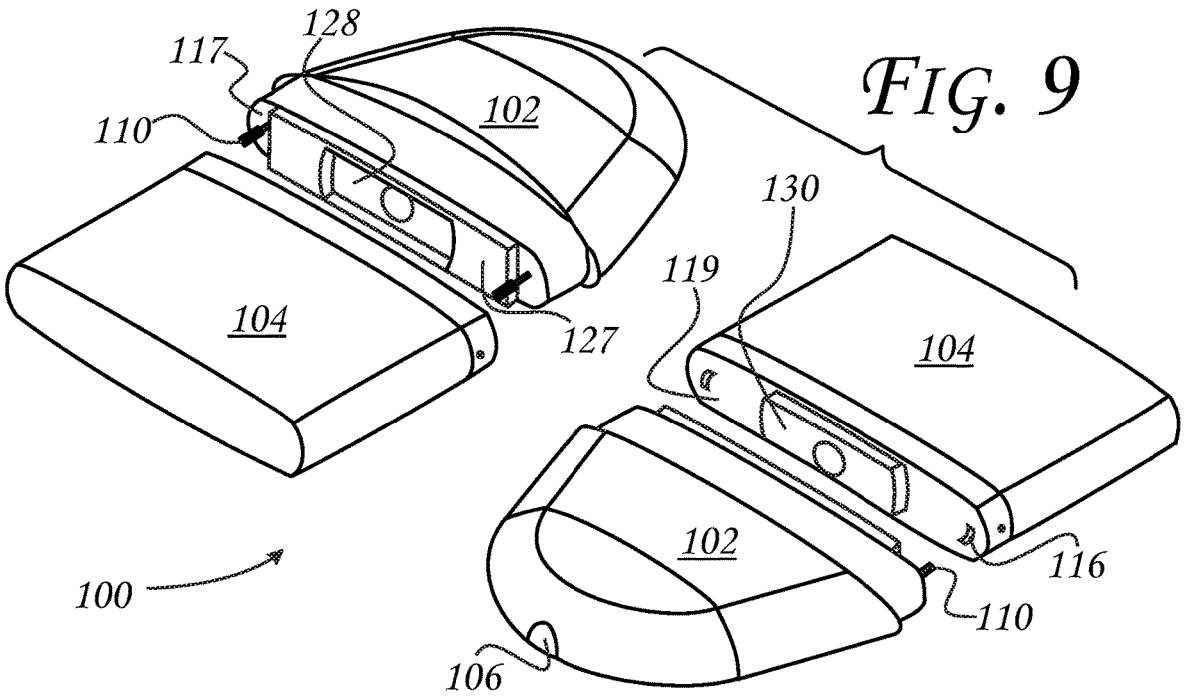
FIG. 9 is a perspective view of an apparatus in accordance with one non-limiting embodiment of a vaporizing cartridge with liquid tank and atomizer for facilitating vaporization of various liquid mediums containing nicotine or pharmaceuticals, wherein an alternative embodiment of a ring slot connection is illustrated.

Referring now to FIG. 9, shown is one additional embodiment and variation in accord with FIG. 5 of the cartridge 100 wherein the liquid tank 102 atomization unit 104 may have additional embodiments. As illustrated the tank engagement face 117 of the liquid tank 102 may have a face cup rim 127 and a face cup 128. The face cup rim 127 may form a protrusion that may rise from the tank engagement face 117 whereby the face cup 128 may then be recessed into. Correspondingly, the atomizer engagement face 119 of the atomization unit 104 may have a face cup insert 130 which may protrude from the atomizer engagement face 119. The face cup 128 of the tank engagement face 117 may fit within the face cup insert 130 of the atomizer engagement face 119 much like a hand into a glove (not shown). With the additional fit of the face cup 128 and face cup insert 130, this particular area may be considered to be an additional securement point for the connection and stabilization of the cartridge 100, and may act very much as the upper connection 108 and lower connection 114. The supportive junction and connection on the middle of the atomizer engagement face 119 by the face cup insert 130 and the tank engagement face 117 by the face cup 128 may well be assisted by a clasping effect of the face cup insert 130 as it is inserted into the face cup 128 preventing lateral movement of the liquid tank 102 with respect to the atomization unit 104. Prevention of lateral movement may permit a proper connection between the upper filling point 110 and the lower filling point 116. Accordingly, this particular embodiment may only have one support point to support the weight of the atomization unit 104 relative to the assembled cartridge 100. The embodiment shown in FIG. 9 may be illustrative of the versatility of the potential selections for supportive junctions wherein only one support point is needed to support the weight of the atomization unit 104 as coupled with the liquid tank 102 to form the cartridge 100 generally which may be sufficient for the stated purpose and well suited to align the upper filling point 110 and the lower filling point 116 for proper e-liquid transfer.

Figure 10:
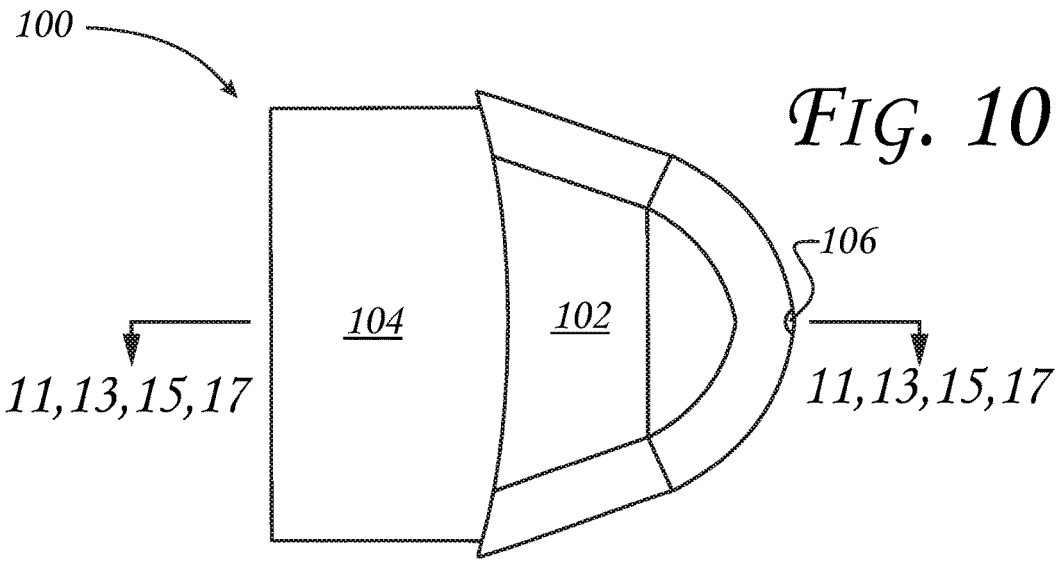
FIG. 10 is a plan view of an apparatus in accordance with one non-limiting embodiment of a vaporizing cartridge wherein the liquid tank and atomizer for facilitating vaporization of various liquid mediums containing nicotine or pharmaceuticals have been placed into a coupled configuration.

FIG. 10 is illustrative of how FIGS. 1 to 9 may appear when properly joined together to form the cartridge 100. Accordingly, the atomization unit 104 and the liquid tank 102 are shown as being together and appear as one unit even though they may have been provided separately to an end consumer, who then joined them together subsequent to obtaining them separately.

Figure 11:
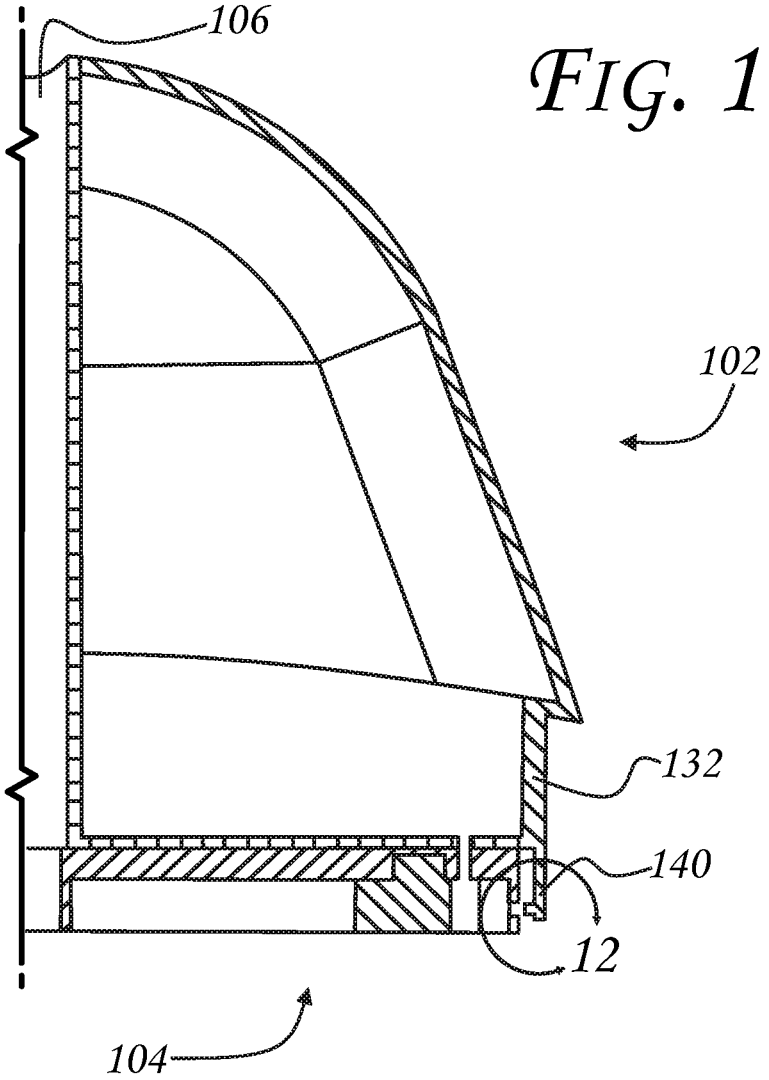
FIG. 11 is a cross-sectional view of an apparatus in accordance with one non-limiting embodiment of a vaporizing cartridge wherein the liquid tank and atomizer are illustrated in one potential clipping configuration.
Figure 12:
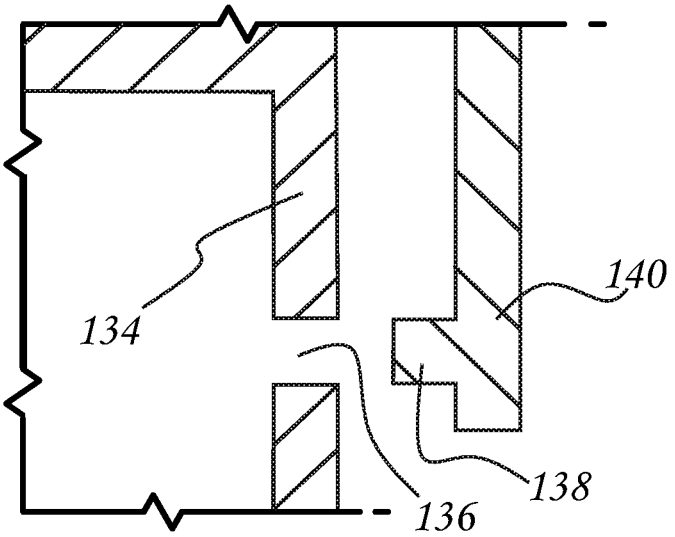
FIG. 12 is a cross-sectional view of an apparatus in accordance with one non-limiting embodiment of a vaporizing cartridge wherein the liquid tank and atomizer are illustrated in one potential clipping configuration.

FIGS. 11 and 12 illustrate a potential connection between one potential embodiment for the upper connection 108 of the liquid tank 102 and lower connection 114 of the atomization unit 104 as illustrated in FIG. 1. Accordingly, this particular connection embodiment may be one in which the outer tank wall 132 of the liquid tank 102 may have a configuration such that the final connected location is one in which the outer tank wall 132 may come to rest external of the outer atomizer wall 134 which thereby further defines a connection point and support junction. This type of connection may have a good load-supporting ability. The strength of this type of connection may result from a number of factors, including but not limited to the depth of a connection aperture 136, the diameter of an engagement member 138, and the general type of material used. This type of connection may have other advantages, such as ease of operation in terms of transitioning from an engaged configuration to a disengaged configuration of the liquid tank 102 and the atomization unit 104 because the engagement member 138 may be located externally to the junction, thus the deflection of the connection arm 140 may not be limited by space. This makes the depth of the connection aperture 136 as one of the potential parameters that define the strength of the connection and may be considered fully adjustable through various design embodiments. Likewise, the process of disengagement may be easier since the connection arm 140 may be pulled laterally away from the assembly, thus making connection arm 140 deflection disengagement process less reliant on an upward pulling force.

Figure 13:
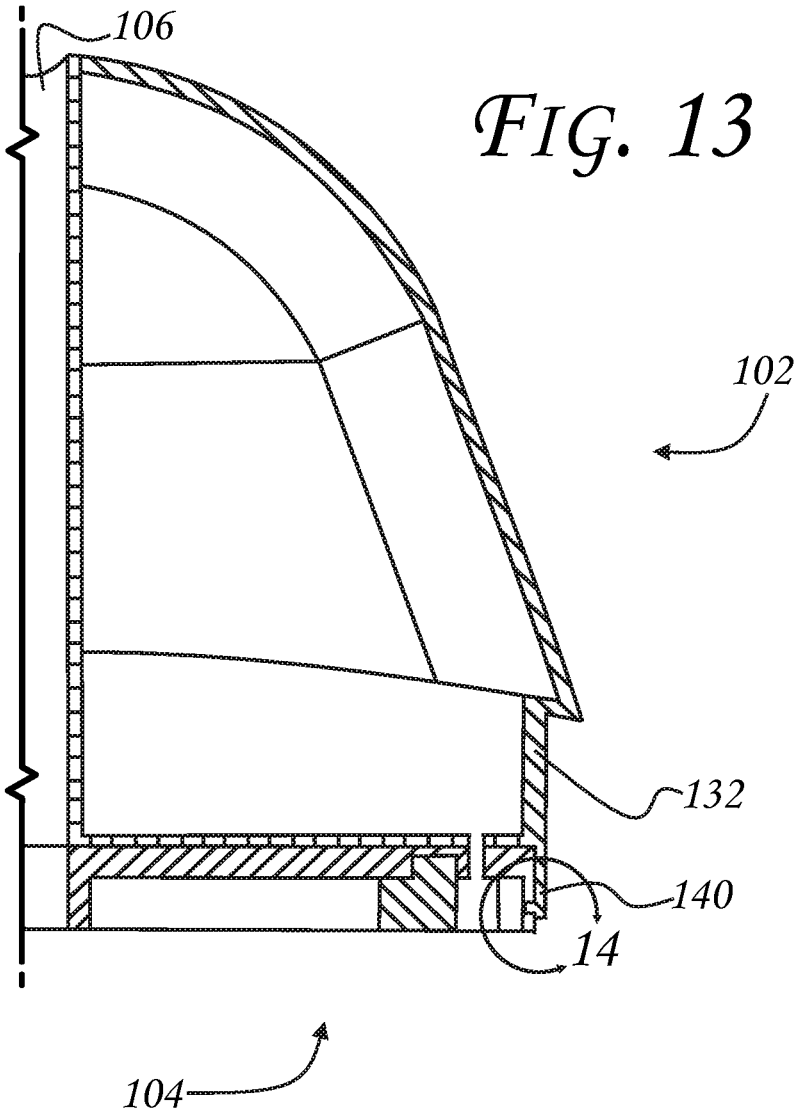
FIG. 13 is a cross-sectional view of an apparatus in accordance with one non-limiting embodiment of a vaporizing cartridge wherein the liquid tank and atomizer are illustrated in one potential clipped configuration.
Figure 14:
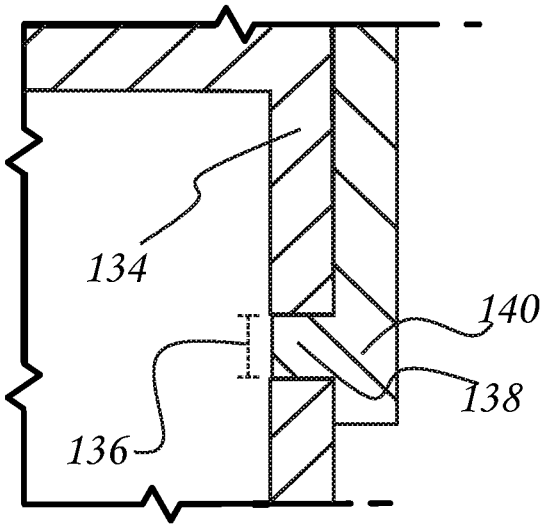
FIG. 14 is a cross-sectional view of an apparatus in accordance with one non-limiting embodiment of a vaporizing cartridge wherein the liquid tank and atomizer are illustrated in one potential clipped configuration.

FIGS. 13 and 14 illustrate a connected and engaged configuration of the above potential embodiment illustrated in FIGS. 11 and 12. Here, the upper connection 108 of the liquid tank 102 and lower connection 114 of the atomization unit 104 as illustrated in FIG. 1 is illustrated as it may appear as a connected unit. Accordingly, FIGS. 13 and 14 may illustrate the outer tank wall 132 of the liquid tank 102 having a configuration such that the final connected location is fully rested onto the external side of the outer atomizer wall 134. The engagement member 138 is shown as being fully inserted into the connection aperture 136 thereby preventing removal of the engagement member 138 without a lateral pulling force applied to the connection arm 140. Thus, this illustrates one potential inserted and engaged configuration with the connection aperture 136 from the engagement member 138. The illustrated dotted lines indicate the approximate size of the connection aperture 136 with the engagement member 138 placed into an engaged configuration as the connection aperture 136 is obscured by the engagement member 138.

FIGS. 15 and 16 illustrate an alternative potential connection between one potential embodiment for the upper connection 108 of the liquid tank 102 and lower connection 114 of the atomization unit 104 as illustrated in FIG. 1. Accordingly, this particular connection embodiment may be one in which the outer tank wall 132 of the liquid tank 102 may have a configuration such that the final connected location is one in which the outer tank wall 132 may come to rest internal of the outer atomizer wall 134 which thereby further defines an alternative connection point and support junction. This type of connection may have a good load-supporting ability. However, this connection may have some limitations due to the trade-off between inherent connection strength obtained by the configuration and the limited operability. Space limitations may be the largest hurdle for the operability of this particular configuration due to the connection arm 140 needing to be laterally deflected towards the center of the cartridge 100 assembly. However, the strength of this type of connection may result from the depth of a connection aperture 136, the diameter of an engagement member 138, and the general fact that the connection may be more difficult to manipulate from the external aspects of the cartridge 100 assembly. The depth of the connection aperture 136 remains one of the potential parameters that define the strength of the connection and may be considered fully adjustable through various design embodiments. Likewise, the process of disengagement may be more difficult because the connection arm 140 may be pulled laterally inward to the cartridge 100 assembly as mentioned, thus making connection arm 140 deflection disengagement process more reliant on an upward pulling force.

Figure 17:
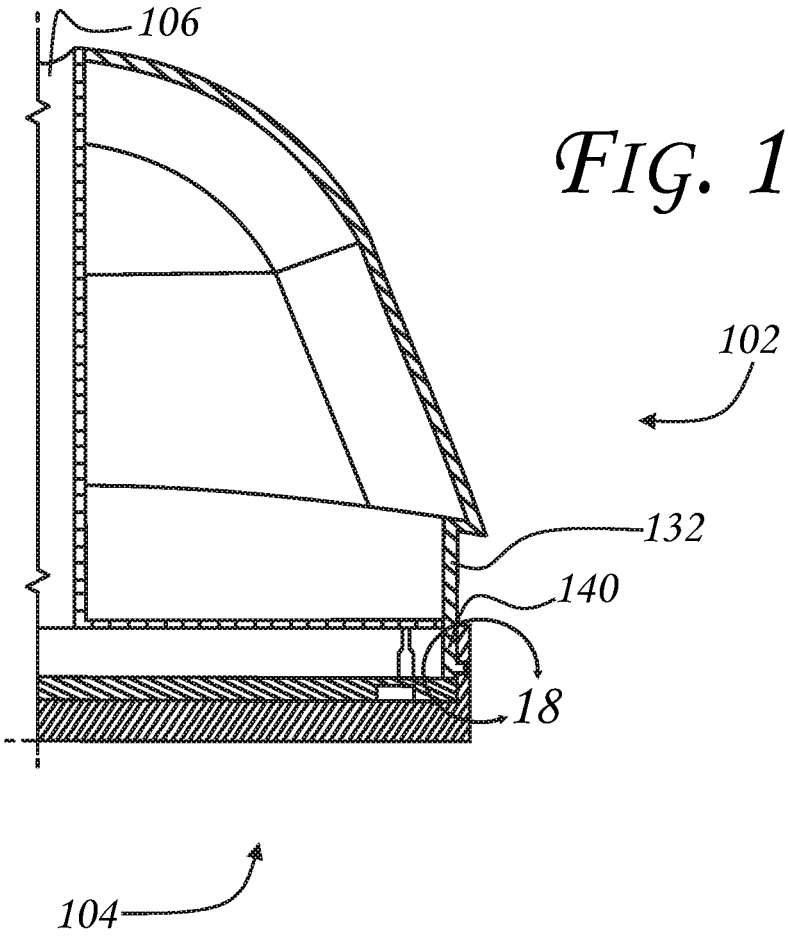
FIG. 17 is a cross-sectional view of an apparatus in accordance with one non-limiting embodiment of a vaporizing cartridge wherein the liquid tank and atomizer are illustrated in one potential clipped configuration.
Figure 18:
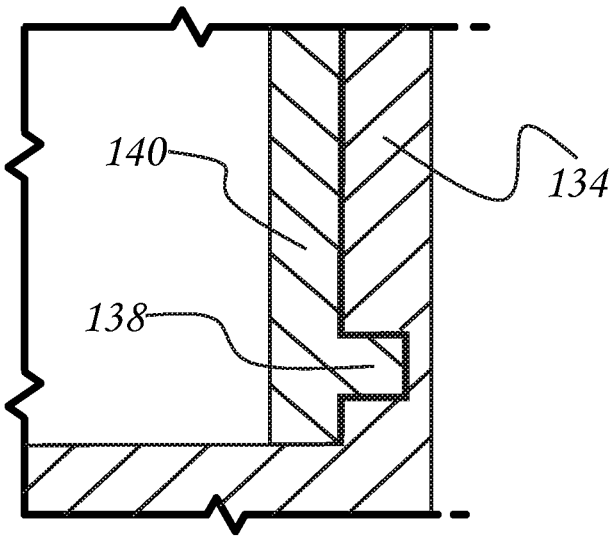
FIG. 18 is a cross-sectional view of an apparatus in accordance with one non-limiting embodiment of a vaporizing cartridge wherein the liquid tank and atomizer are illustrated in one potential clipped configuration.

FIGS. 17 and 18 illustrate a connected and engaged configuration of the above potential embodiment illustrated in FIGS. 15 and 16. Here, the upper connection 108 of the liquid tank 102 and lower connection 114 of the atomization unit 104 as illustrated in FIG. 1 is illustrated as it may appear as a connected unit. Accordingly, FIGS. 15 and 16 may illustrate the outer tank wall 132 of the liquid tank 102 having a configuration such that the final connected location is fully rested onto the internal side of the outer atomizer wall 134. The engagement member 138 is shown as being fully inserted into the connection aperture 136 thereby preventing removal of the engagement member 138 without a lateral pulling force applied to the connection arm 140. Thus, this illustrates one potential inserted and engaged configuration with the connection aperture 136 from the engagement member 138. The connection aperture 136 is not indicated as the connection aperture 136 is obscured by the engagement member 138.

Figure 19:
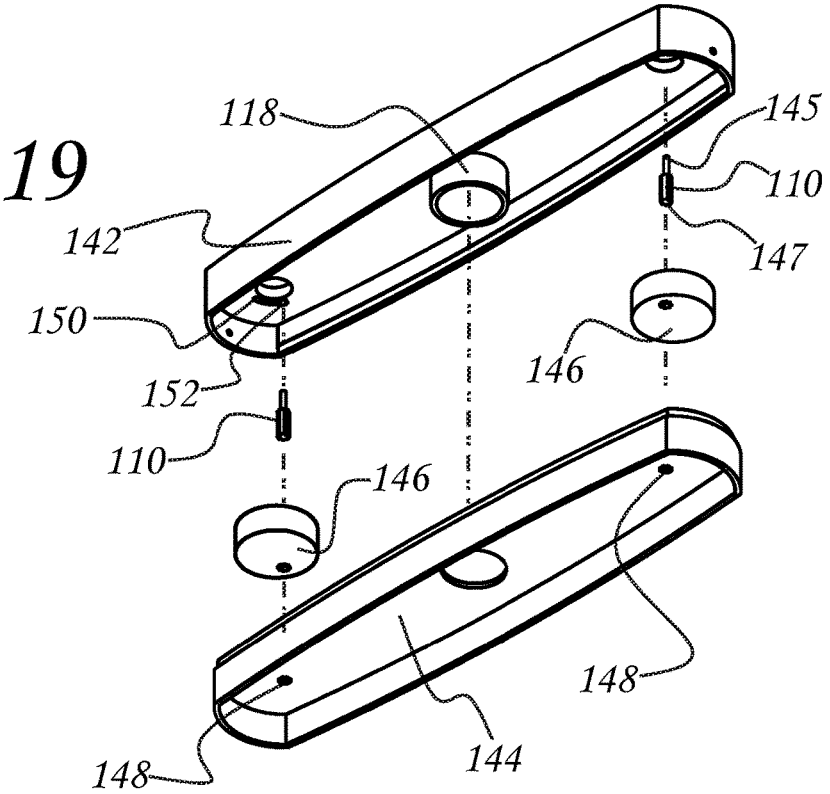
FIG. 19 is an exploded view of one non-limiting embodiment of an atomization plate assembly.
Figure 20:
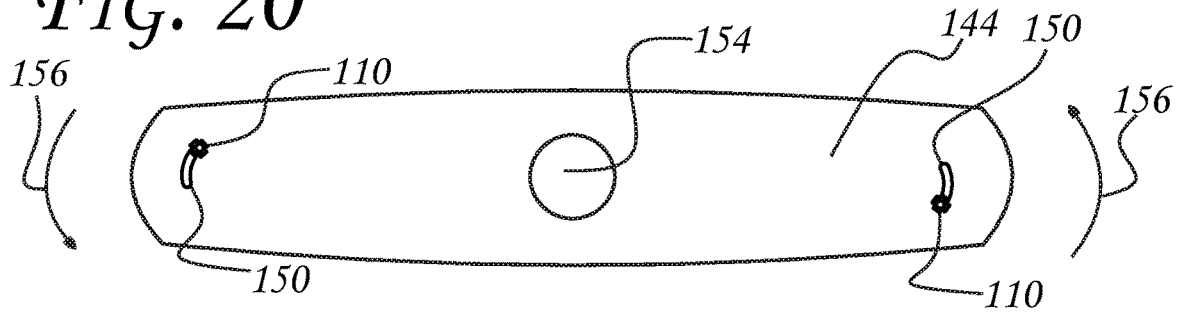
FIG. 20 is a cross-sectional view of one non-limiting embodiment of an atomization plate assembly as it may transition from an unlocked to a locked configuration.
Figure 21:
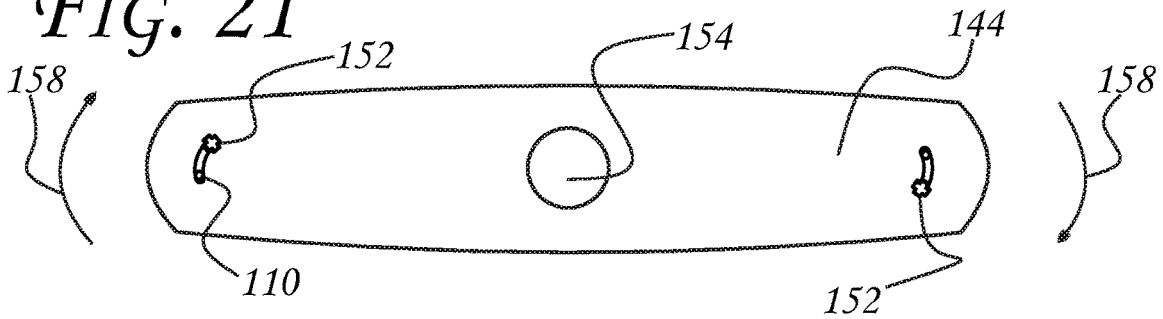
FIG. 21 is a cross-sectional view of one non-limiting embodiment of an atomization plate assembly as it may transition from a locked to an unlocked configuration.

FIGS. 19, 20, and 21 illustrate the type of connection that may allow the upper filling point 110 and the lower filling point 116 (not shown) to become more unified for e-liquid filling by acting as a stabilizing connection through the utilization of a locking type mechanism concept between an atomization unit cover 142 and a lock interface plate 144. The atomization unit cover 142 may be located to the atomization unit 104 (shown in FIG. 1) and the lock interface plate 144 may be located to the junction between the atomization unit cover 142 and the atomization unit 104. This particular embodiment may result in a configuration wherein no additional securement points would be necessary. Specifically illustrated in FIG. 19 is an exploded view of the assembly for the lock interface plate 144 and atomization unit cover 142 assembly. The lock interface plate 144 may utilize a retention plate 146 for the retention of the upper filling point 110. The upper filling point 110 may be further be defined and divided into a liquid tank end 145 and an atomization unit end 147. As can be seen, the atomization unit end 147 may be in the shape of a cross, and be configured such that it may be enclosed by the engagement slot 150 after passing through the keyhole 148. The upper filling point 110 may be of any shape which would reasonably suit the purposes of liquid engagement between the atomization unit 104 and the liquid tank 102 and should not be limited to that of a cross shape solely because it is displayed in this disclosure as such.

As noted, the atomization unit end 147 of the upper filling point 110 may pass through a keyhole 148 in the lock interface plate 144 in this embodiment such that it may engage with an insert hole 152 located on the atomization unit cover 142. When engaged, as illustrated in FIG. 21, the upper filling point 110 as it may be locked into the engagement slot 150 of the atomization unit cover 142 may constitute connection securement points and liquid transfer points in one engagement. The disengagement of the liquid tank 102 (not shown) from the atomization unit 104 (not shown) may then occur by the reverse of the rotational connection as indicated in FIG. 20. Accordingly, the rotation indicator of FIG. 20 indicates a locking rotation 156, while the rotation indicator of FIG. 21 indicates an unlocking rotation 158.

As illustrated in cross-sectional FIGS. 20 and 21, the liquid tank end 145 of the upper filling point 110 may be aligned with the insert hole 152 such that the atomization unit cover 142 may be slightly off-center. A rotational movement as indicated in FIGS. 20 and 21 of the liquid tank 102 may result in the upper filling point 110 rotating from the insert hole 152 and along the semi-hemispherical path defined by the engagement slot 150. The upper filling point 110 may be designed such that it may pass through the keyhole 148 and through the insert hole 152 but not through the engagement slot 150 thus locking the upper filling point 110 into place and permitting e-liquid to flow from the liquid tank 102 (not shown) to the atomization unit 104 (not shown). This type of filling point securement connection can also prevent other random liquid tanks from engaging with the atomization unit without the same engagement configuration and/or engagement shape of the liquid tank end 145 of the upper filling point 110. The FIG. 21 herein illustrates the circular portion of the upper filling point 110 because of the cross sectional nature of the FIG. 21. It should be understood that this is illustrative of the atomization unit end 147 of the upper filling point 110 as the liquid tank end 145 of the upper filling point 110 has passed through and beyond the insert hole 152.

The locking mechanism illustrated in FIGS. 19, 20, and 21 may occur by way of inserting the atomization unit end 147 of the upper filling point 110 into the insert hole 152 until the reaches the bottom of the retention plate 146. At this insertion point, the atomization unit end 147 of the upper filling point 110 should be in contact with the atomization unit 104 but not aligned with the key hole 148 as illustrated in FIG. 20 and thus, no liquid may flow from the liquid tank 102 to the atomization unit 104. By rotating the liquid tank 102 across the atomization unit cover 142 as illustrated by the locking rotation 156 indicated in FIG. 20, the alignment of the key hole 148 with the upper filling point 110 may occur as illustrated in FIG. 21. The liquid tank end 145 of the upper filling point 110 may move along the hemispherical path of the engagement slot 150 until it reaches alignment at the end of the engagement slot 150 path and the upper filling point 110 is aligned with the key hole 148. This rotational movement of the locking rotation 156 and the unlocking rotation 158 also rotates the retention plate 146 and the upper filling point 110 in unison so that alignment may be altered from an engaged and aligned configuration, to a disengaged and unaligned configuration. An engaged configuration may result in the movement of liquid from the liquid tank 102 to the atomization unit 104 while an unengaged configuration may prevent liquid from moving from the liquid tank 102 to the atomization unit 104.

Figure 22:
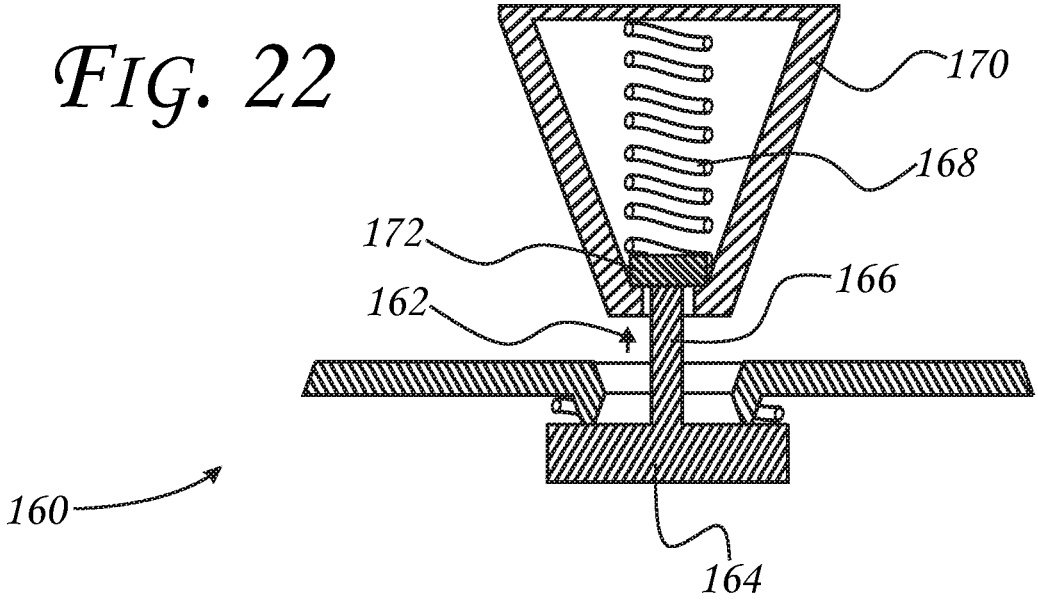
FIG. 22 is a cross-sectional view of one non-limiting embodiment of a lift valve assembly in a closed configuration.
Figure 23:
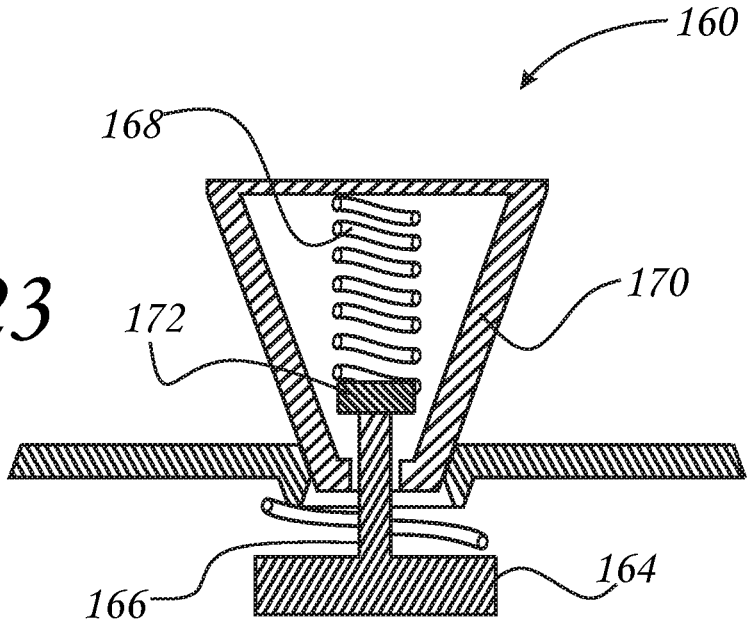
FIG. 23 is a cross-sectional view of one non-limiting embodiment of a lift valve assembly in an open configuration.

Referring now to FIGS. 22 and 23, shown is a type of filling point engagement that utilizes lift-valve like mechanism herein referred to as a biasing valve 160. This type of filling point connection may have advantages resulting in a high degree of operability due to the simple mechanism of only requiring a linear pushing force 162 to the filling plate 164. Accordingly, the filling plate 164 may be attached to a transfer arm 166 which may then be attached to a biasing spring 168. Thus, an applied linear pushing force 162 to the filling plate 164 may transfer a potential energy load to the biasing spring 168 via the transfer arm 166 as indicated between FIGS. 22 and 23. Thus, FIG. 23 shows the biasing valve 160 in an open configuration, while FIG. 22 shows the biasing valve 160 in a closed configuration. When a linear pushing force 162 is no longer being applied to the filling plate 164, the potential energy load stored in the biasing spring 168 may transfer the filling plate 164 back down to a closed position as shown in FIG. 22.

Moreover, this particular configuration may permit both the upper filling point 110 (not shown) and the lower filling point 116 (not shown) to be open simultaneously when the liquid tank 102 (not shown) is in an engaged configuration with the atomization unit 104 (not shown). The biasing spring 168 as it may be attached to the filling plate 164 and may be associated with the atomization unit 104 (not shown). The funnel 170 may be associated with the liquid tank 102. Thus, the transfer arm 166 may also be associated with the atomization unit 104 and push into the liquid tank fill plate 172 and result in the buildup of potential energy and the transfer of e-liquid to pass from the liquid tank 102 (not shown) to the atomization unit 104 (not shown).

FIG. 24 may illustrate an alternative embodiment of the cartridge which may have separable parts which may consist of an outer housing 174 which may surround the atomization unit 104 (not shown), a liquid tank 102 (illustrated as empty), and an elongated atomization chamber 176. In this model, the elongated atomization chamber 176 may be attached to the bottom of the liquid tank 102 via a threaded connection, friction connection, clip connection, or any other type of connector or connection commonly used in the industry. The attachment of the outer housing 174 to the liquid tank 102 may be performed by using a threaded connection, friction connection, clip connection, or any other type of connector or connection commonly used in the industry.

FIG. 25 illustrates an alternative design embodiment of the cartridge 100 in a joined configuration. Accordingly, this FIG. is illustrative of the use of a vapor duct plug 178. The vapor duct plug 178 may be made of any material which is elastic in nature, or of a wide variety of rigid plastics, provided that it may completely plug the vapor duct 106 (not shown) from leaking out of the end of the liquid tank 102. Additionally, the vapor duct plug 178 may be of a combination of an elastic material and that of a rigid material.

Figure 26:
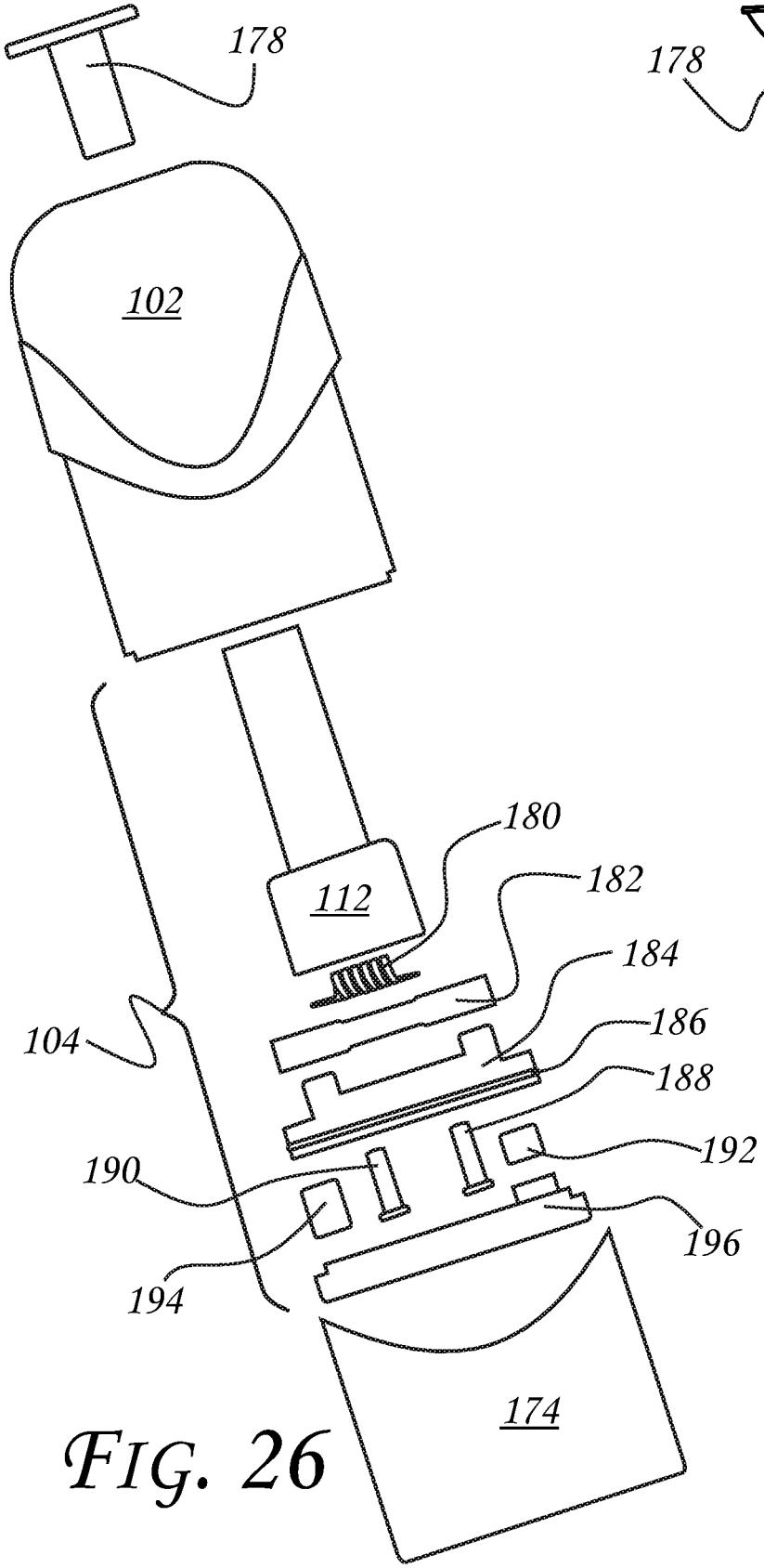
FIG. 26 is a plan exploded view of FIG. 25, wherein the constituent internal components are illustrated.

Referring to FIG. 26, illustrated is an exploded and detailed view of an additional embodiment of the cartridge 100. This figure may be well illustrative of some of the internal components of the atomization unit 104. Shown are the atomization chamber 112, a coil 180, a liquid transfer medium 182, an elastomeric support mount 184, an elastic fill band 186, a first conductive post 188, a second conductive post 190, a first magnet 192, a second magnet 194, a base mount 196, and the outer housing 174. The elastomeric support mount 184 may serve to seal the lower portion of the atomization unit 104 and it may also serve to seal the lower portion of the liquid tank 102 depending on the selected configuration from the manufacturer. Accordingly, the second magnet 194 may correspond to a positional location of the biasing valve 160. The base mount 196 may be mounted under the elastomeric support mount 184 and above the second magnet 194. Further, the elastomeric support mount 184 may utilize a membrane (not shown) for the filling process wherein a needle is inserted into the membrane (not shown) and then the second magnet 194 is subsequently placed adjacent to the fill location of the membrane (not shown) thereby sealing up the specific filling hole created by the needle (not shown).

Figure 27:
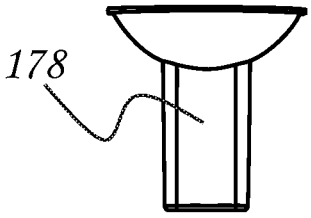
FIG. 27 is a plan view of one alternative and non-limiting embodiment of a vapor duct plug.

FIG. 27 illustrates an alternative design embodiment of the vapor duct plug 178 as it may appear not engaged with the vapor duct 106. This embodiment of the vapor duct plug 178 may be made of any material which is elastic in nature, or of a wide variety of rigid plastics, provided that it may completely plug the vapor duct 106 (not shown) from leaking out of the end of the liquid tank 102. Additionally, the vapor duct plug 178 may be of a combination of an elastic material and that of a rigid material.

Figure 28:
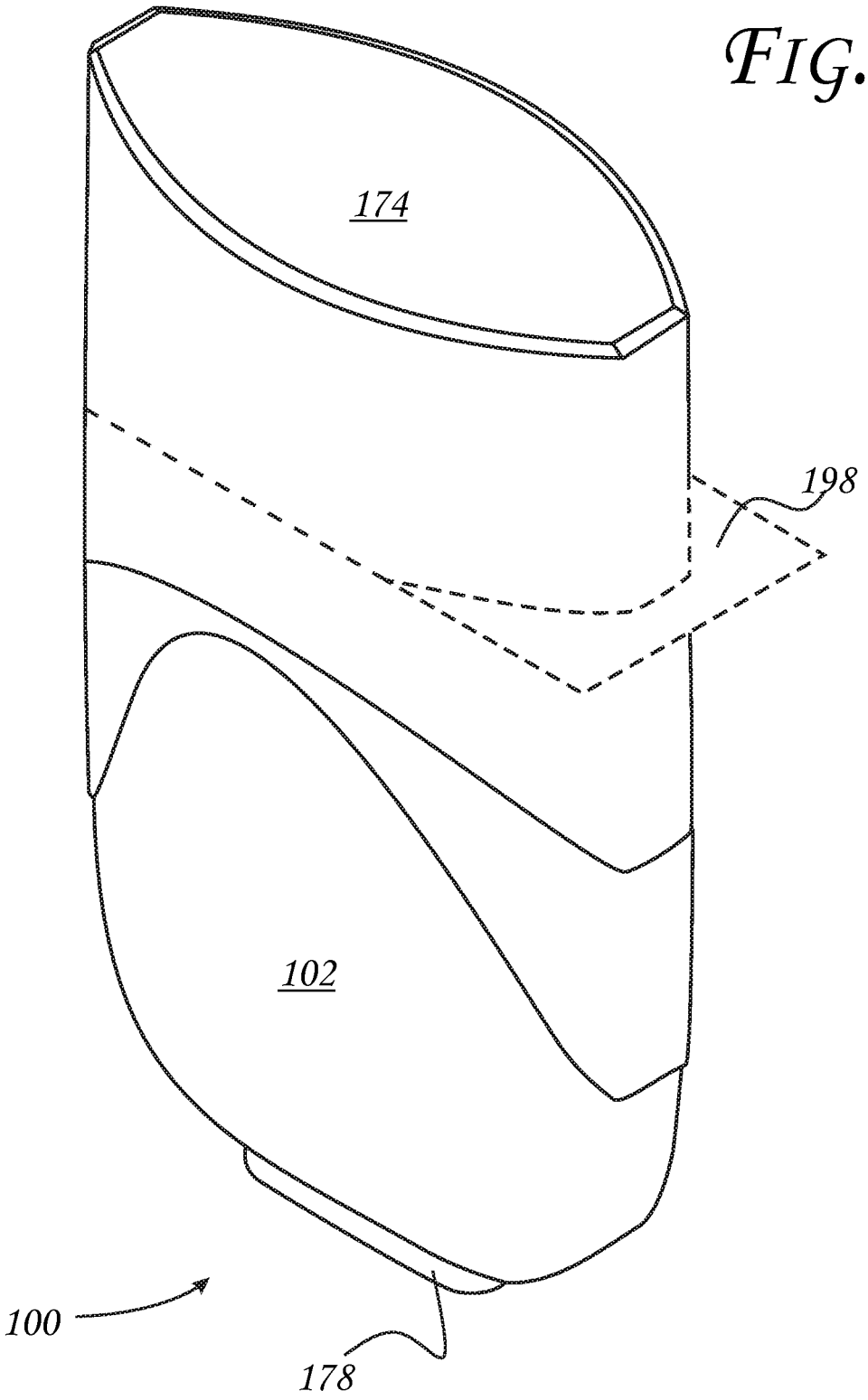
FIG. 28 is a perspective view of an apparatus in accordance with one alternate non-limiting embodiment of a vaporizing cartridge wherein the liquid tank and atomizer have been placed into a coupled configuration and a membrane separator locationally indicated.

FIG. 28 illustrates one potential embodiment for a separation seal 198 for use with the liquid tank 102 and the atomization unit 104, illustrated in FIG. 28 in dotted lines as it would otherwise be completely obscured by the outer housing 174. It should be noted that the seal 198 would not originally be positioned such as this, FIG. 28 is used as illustrative only to indicate the relative position of the seal 198 in relation to the entire cartridge 100. The seal 198 is intended to be removed prior to assembling the atomization unit 104 with the liquid tank 102. Accordingly, the seal 198 may be used to close the liquid tank 102 until an end consumer may be desirous of the contents of the liquid tank 102. Thus, as illustrated in FIGS. 29, 30, and 31, an end-user may then peel off the seal 198 which was holding the e-liquid internal of the liquid tank 102. FIG. 29 shows the seal 198 as it may be positioned on purchase by an end consumer and ready for removal. FIG. 30 indicates mid removal of the seal 198. Finally, FIG. 31 shows the seal 198 fully removed and the liquid tank 102 ready for installation with an atomization unit 104 (not shown).

Figure 32:
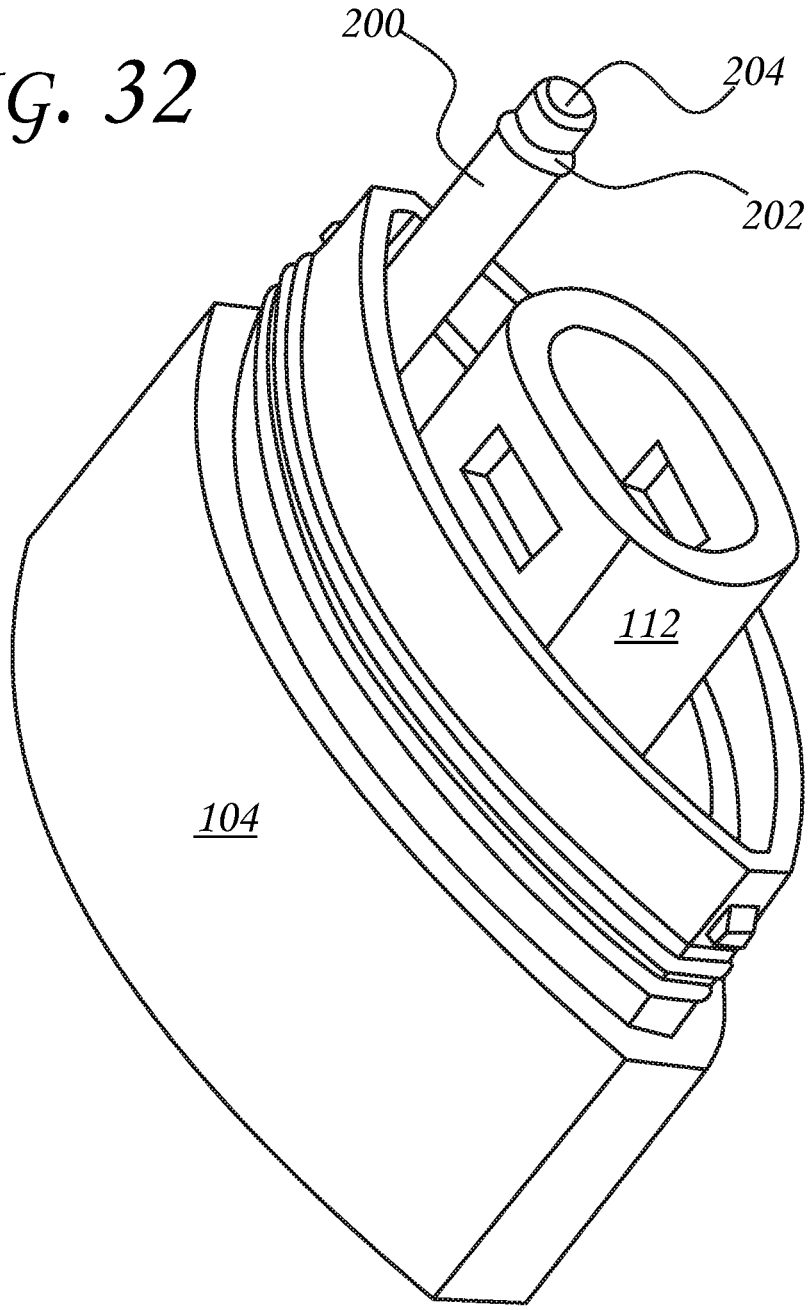
FIG. 32 is a perspective view in accordance with one alternate non-limiting embodiment of an atomizer wherein a tamper post is illustrated in a position favorable to promote anti-tampering.
Figure 33:
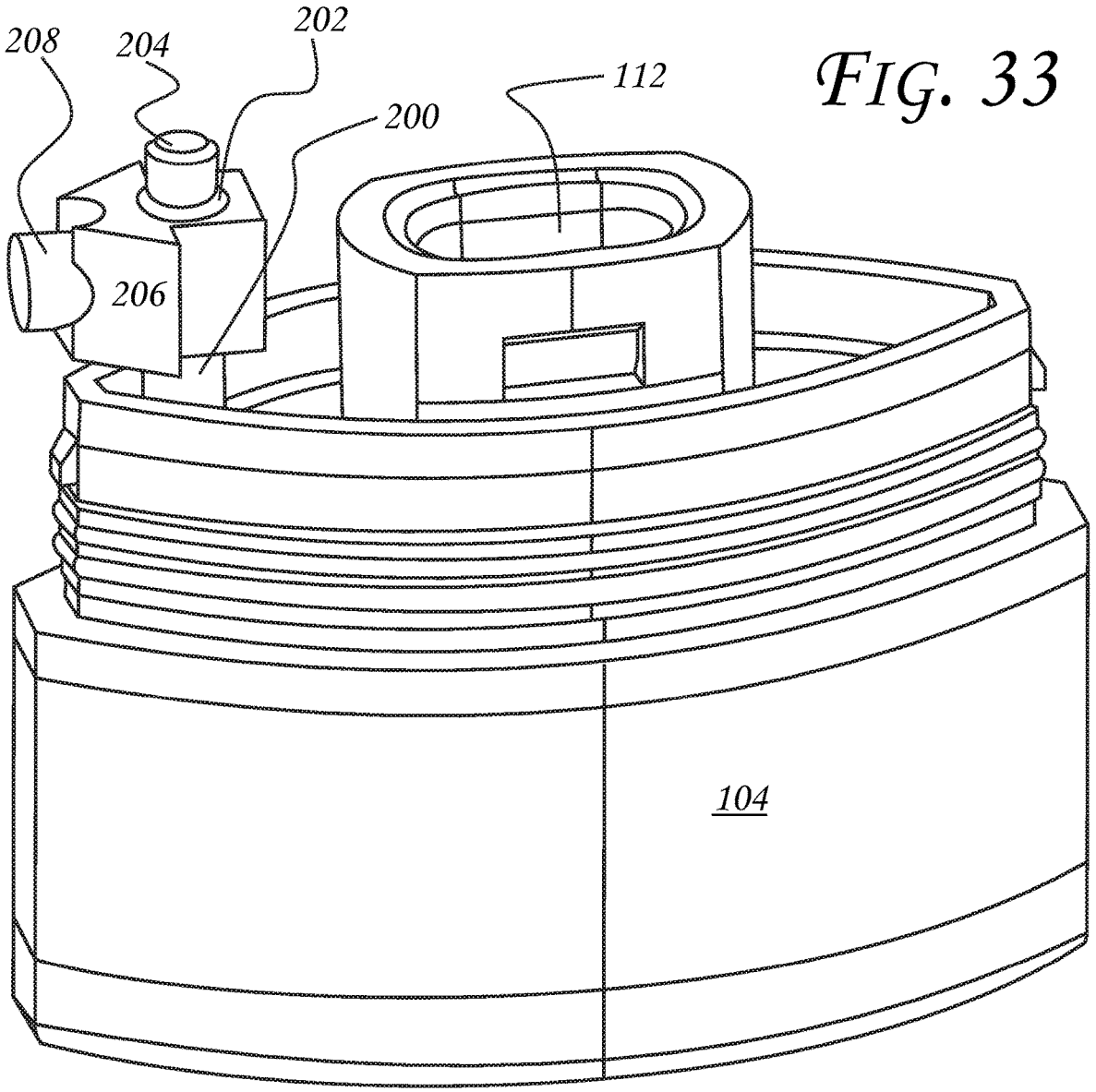
FIG. 33 is a perspective view in accordance with one alternate non-limiting embodiment of an atomizer wherein a tamper post is illustrated as being coupled with an anti-tamper plug which may be favorable to promote anti-tampering.
Figure 34:
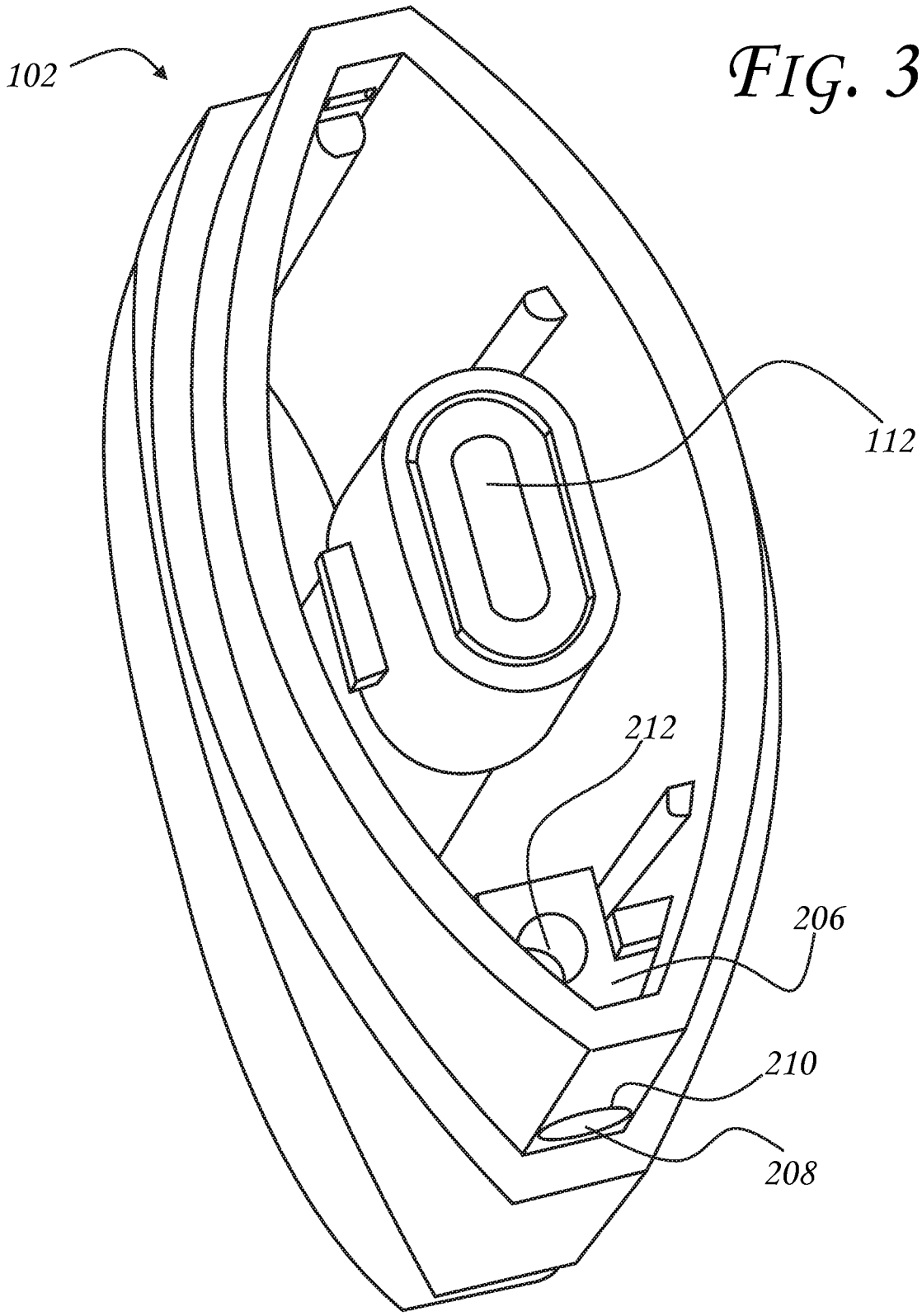
FIG. 34 is a perspective view in accordance with one alternate non-limiting embodiment of a tank wherein an anti-tamper plug is illustrated in an engaged configuration as it may appear when the tank is coupled with the atomizer thus resulting in a position favorable to dissuade decoupling.

FIGS. 32, 33, and 34 illustrate one potential anti-tampering and anti-disengagement embodiment for a cartridge 100 which is not intended to be separated subsequent to the union by an end consumer. Shown in FIG. 32 is a mating post 200. The mating post 200 may have an entrapment notch 202 and a tapered end 204. The tapered end 204 may be designed such that it may easily engage with an anti-removal plug 206 as seen in FIG. 33. FIG. 33 specifically details how the mating post 200 may be configured to engage with the anti-removal plug 206 without the obscurity of the liquid tank 102 preventing the view. Moreover, the anti-removal plug 206 may come preinstalled internal to the liquid tank 102 such that when the atomization unit 104 is engaged with the liquid tank 102, the mating post 200 of the atomization unit 104 will engage with the anti-removal plug 206 located internal to the liquid tank 102. Thus, once engaged in this particular embodiment, disengagement would render the liquid tank 102 non-functional as further described in accord with the below.

As seen in FIGS. 33 and 34 the anti-removal plug 206 may have a liquid seal member 208 to one end of the anti-removal plug 206. As seen in FIG. 34, the liquid seal member 208 may engage with a liquid tank hole 210 located to one side of the liquid tank 102. The liquid seal member 208 may close this liquid tank hole 210 such that no e-liquid may leak from the liquid tank 102. Should an end-user of the cartridge 100 decide to separate this embodiment subsequent to a union, then the liquid tank 102 would have a fatal leak in the side at the location of the liquid tank hole 210. Should an end-user of the cartridge 100 pull with sufficient force to separate the liquid tank 102 from the atomization unit 104, the entrapment notch 202 may prevent the anti-removal plug 206 from staying in the liquid tank 102 and would instead remain bound to the mating post 200 of the atomization unit 104. FIG. 34 specifically details how the anti-removal plug 206 may come pre-installed in the liquid tank 102 and may be in a configuration which may be ready to engage with the mating post 200 (shown in FIG. 33).

Figure 35:
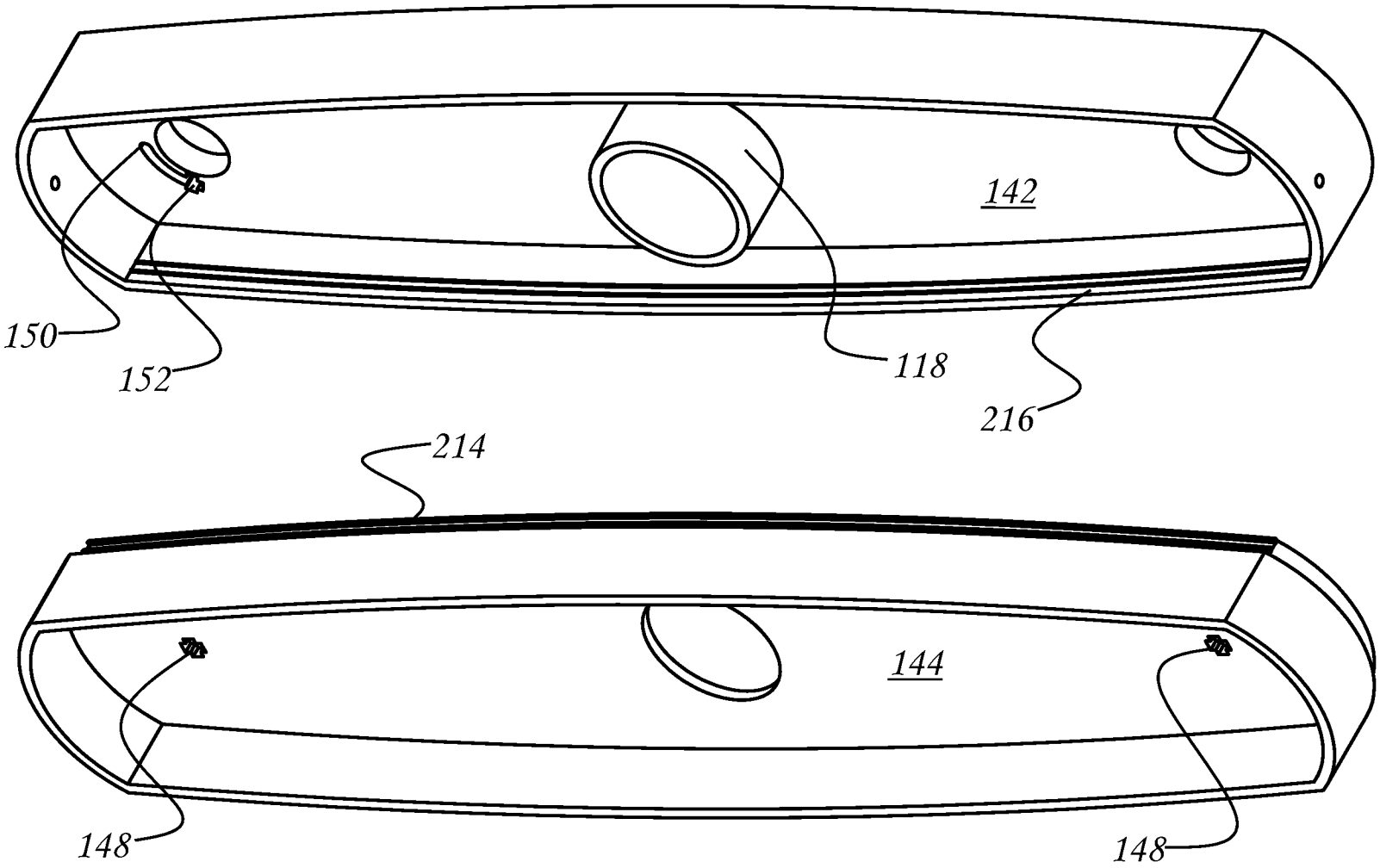
FIG. 35 is an enlarged perspective view of FIG. 19 where certain non-limiting embodiment of the atomization plate assembly are more clearly illustrated.
Figure 36:
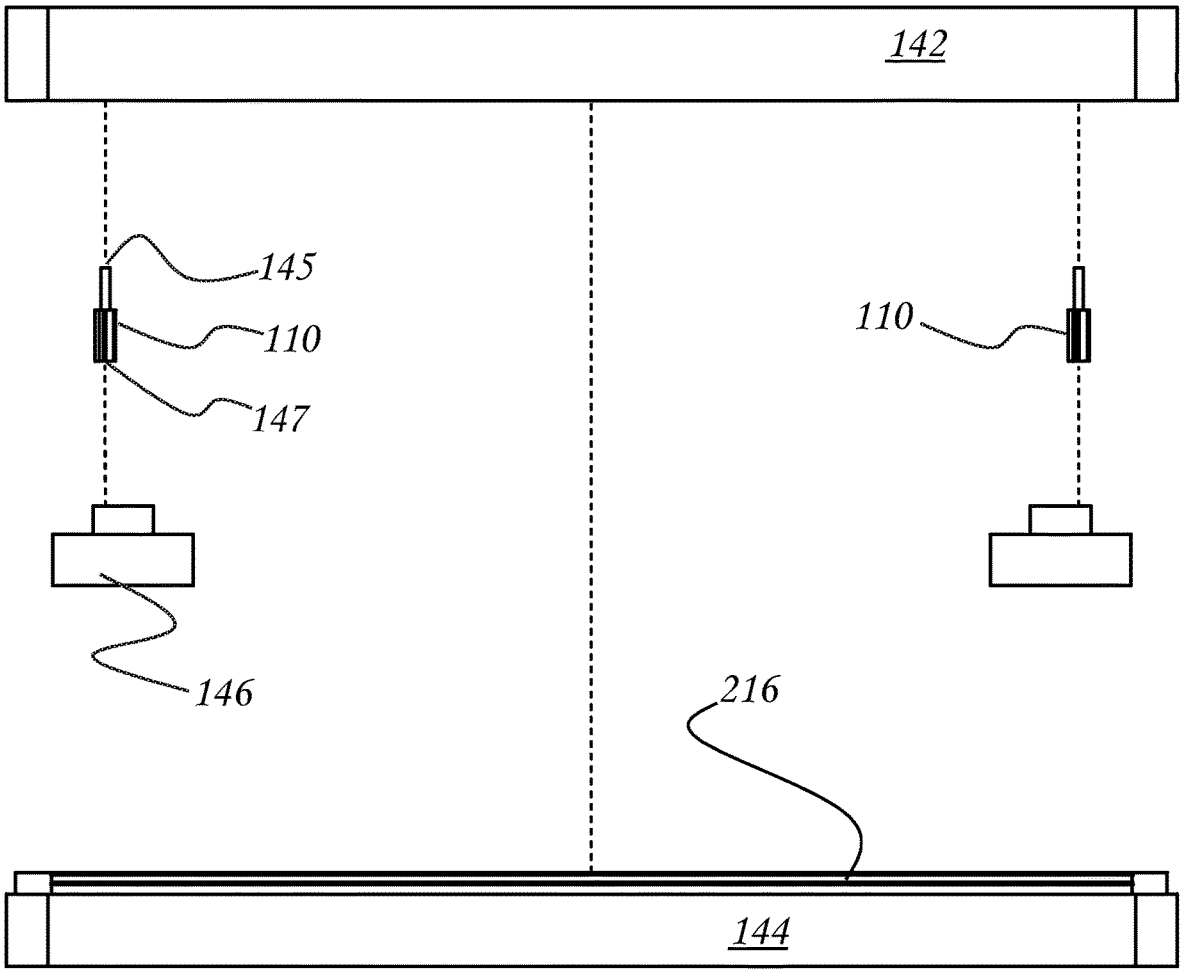
FIG. 36 is an enlarged plan view of FIG. 19 where certain non-limiting embodiment of the atomization plate assembly are more clearly illustrated.

Turning now to FIGS. 35 and 36, illustrated are enlarged views wherein some of the components of FIG. 19 may be viewed with greater detail. Additionally shown here is the means by which the atomization unit cover 142 may clip onto the lock interface plate 144. Seen is clipping ledge 214 located on the lock interface plate 144 and a clasping ledge 216 located onto the atomization unit cover 142. Accordingly, the clipping ledge 214 may insert into clasping ledge 216 such that the two may be retained in a static position relative to each other and may further be configured to retain the retention plate 146 in place.

Figure 37:
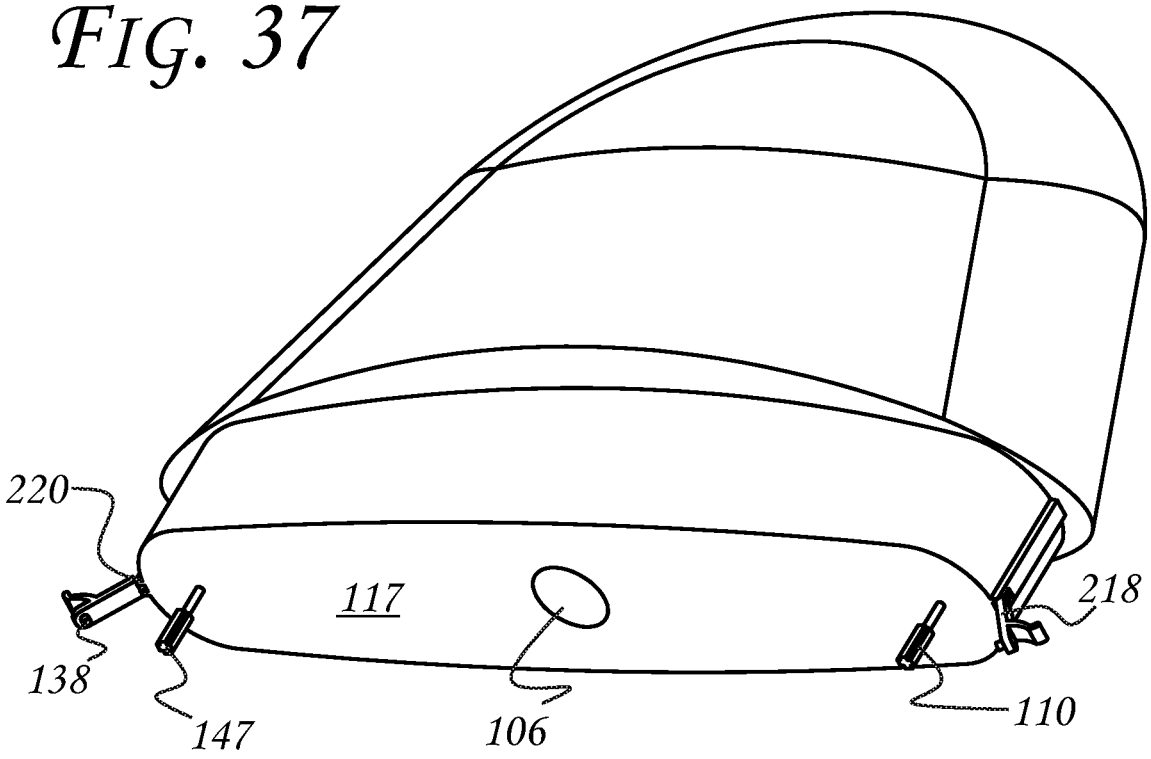
FIG. 37 is an enlarged perspective view of an apparatus in accordance with one alternate non-limiting embodiment of a vaporizing cartridge wherein the liquid tank is illustrated as having an alternate connection mode for coupling with the atomization unit.
Figure 38:
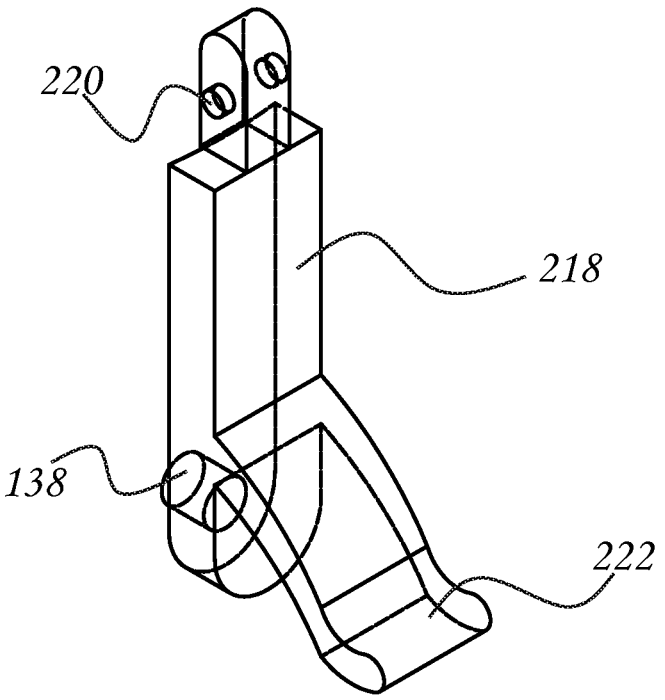
FIG. 38 is an enlarged perspective view of a competent for the alternate connection mode for coupling with the atomization unit according to the non-limiting embodiment of FIG. 37.
Figure 39:
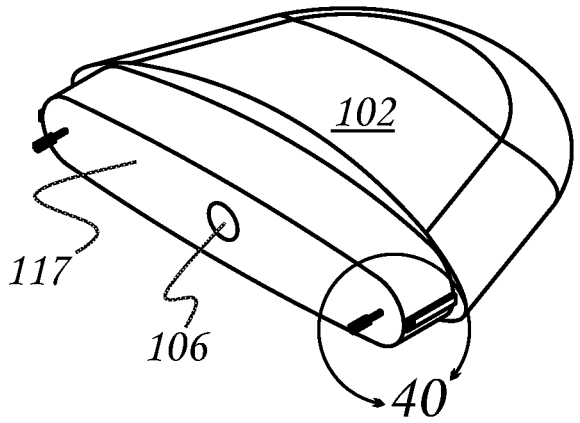
FIG. 39 is a perspective view of the alternate connection mode for coupling with the atomization unit according to the non-limiting embodiment of FIG. 37 wherein the component of FIG. 38 is shown uninstalled.
Figure 40:
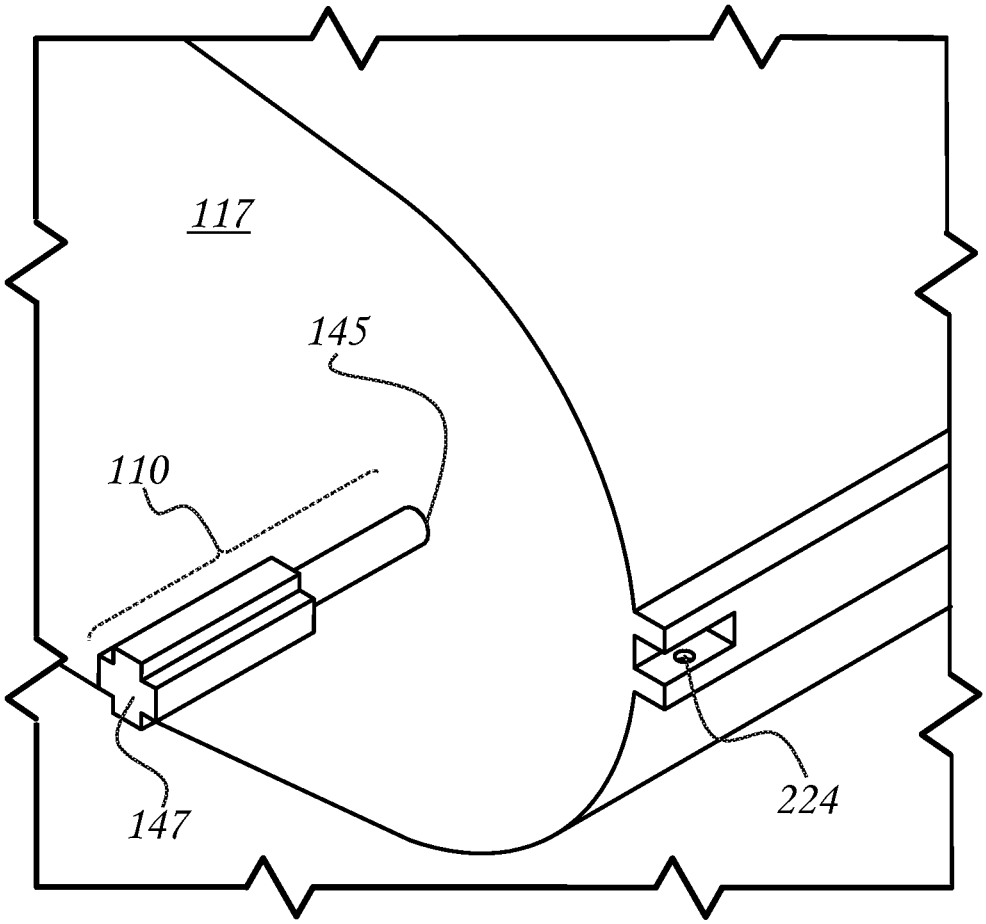
FIG. 40 is an enlarged perspective view of the alternate connection mode for coupling with the atomization unit according to the non-limiting embodiment of FIG. 37 wherein the component of FIG. 39 is shown uninstalled; and, FIG. 41 is an perspective view of an apparatus in accordance with one alternate non-limiting embodiment of a vaporizing cartridge wherein the liquid tank is illustrated with an alternative sealing embodiment of the upper fill points.

Referring now to FIGS. 37, 38, 39, and 40, illustrated is an alternative embodiment for the retention of the liquid tank 102 to the atomization unit 104. Illustrated in FIGS. 37 and 38 is a latch 218 for use in engaging with the connection aperture 136 of FIG. 11. In FIG. 37, the connection arm 140 is modified such that there is a hinge 220 at the same planer location as the tank engagement face 117. The hinge 220 may have a lever 222 wherein an upward pull to the may result in disengagement of the engagement member 138 from the connection aperture 136 (as illustrated in FIG. 12). Illustrated in FIG. 39 is a view of a hinge slot 224 for the hinge 220. For better viewing, the lever 222 is not in place. Moreover, the upper filling point 110 may be welled viewed in FIG. 40 showing both ends of the upper filling point 110. It may be seen that the atomization unit end 147 is of a larger size than the liquid tank end 145 which may result in the atomization unit end 147 becoming entrapped when in an engaged configuration (as previously discussed). The hinge slot 224 may permit the smooth transition for the hinge 220 to transition from a locked configuration to an unlocked configuration. A locked configuration may correspond to the engagement member 138 being inserted into the connection aperture 136 (not shown) and an unlocked configuration may correspond to the engagement member 138 being removed from the connection aperture 136 (not shown).

Figure 41:
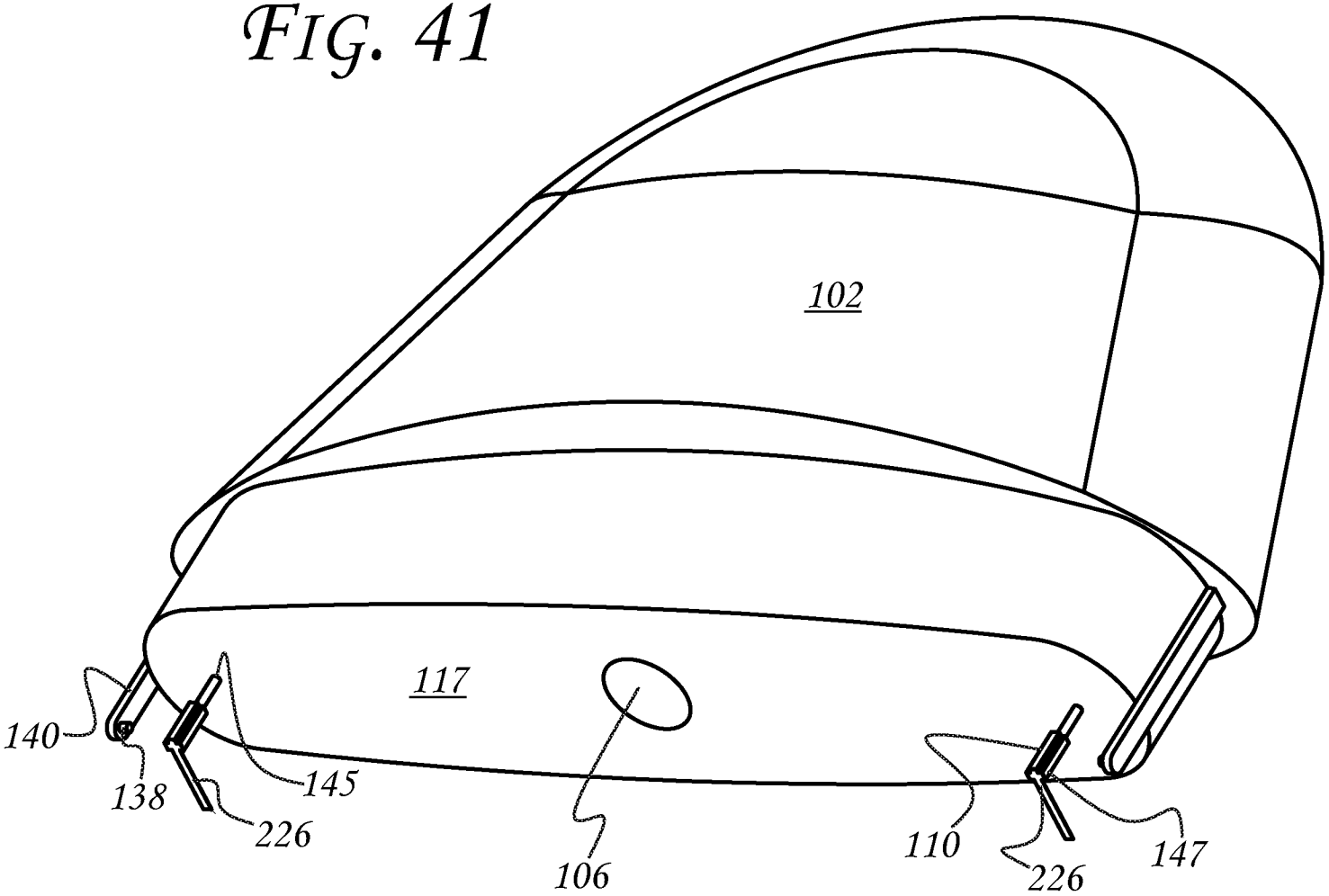

Shown in FIG. 41 is that of an alternative embodiment as illustrated in FIGS. 29, 30, and 31. This particular embodiment uses a similar seal 198 (not shown) but elects to cover the atomization unit end 147 of the upper filling point 110 with an upper filling point seal 226. Per this particular configuration, the upper filling point seal 226 may obstruct only the two atomization unit end 147 upper filling points 110. This configuration may then work similarly as in FIGS. 29, 30, and 31, wherein the removal of the upper filling point seal 226 may be required prior to the attachment of the liquid tank 102 to the atomization unit 104 (not shown).

Having disclosed the structure of the preferred embodiments, it is now possible to describe its function, operation, and use. Accordingly, the various components of the cartridge 100 may be made from any suitable type of material, including but not limited to a wide range of plastics, silicones and other elastomeric materials, glass, elemental metals, alloys, hardened silicate structures, cotton or other flexible fibers. Moreover, the particular material selected to construct any one individual component may be in accord and in consideration with the particular job the component is selected to perform.

Certain embodiments of this disclosure may describe a combinable and separable cartridge 100 which may have an atomization unit 104 and a liquid tank 102 which are separate from each other. The atomization unit 104 may further have an atomization chamber 112, at least one and possibly more than one a lower filling point 116, and an atomizer engagement face 119. The liquid tank 102 may further have a vapor duct 106, and at least one and possibly more than one an upper filling point 110, and a tank engagement face 117. The atomization unit 104 may be prefilled with a liquid medium for use in vaporizing the e-liquid. The upper filling point 110 of the liquid tank 102 and the lower filling point 116 of the atomization unit 104 may be configured to mate together, wherein said mating of the upper filling point 110 and the lower filling point 116 may form a liquid permeable connection between the atomization unit 104 and the liquid tank 102 allowing the liquid medium to permeate from the liquid tank 102 to the atomization unit 104.

Moreover, the liquid tank 102 may further comprise at least one and possibly more than one an upper connection 108 and the atomization unit 104 may comprise at least one and possibly more than one a lower connection 114. The upper connection 108 and the lower connection 114 may be configured to reversibly mate together providing stabilization connections between the liquid tank 102 and the atomization unit 104.

Alternatively the atomizer engagement face 119 may further comprise an atomization protrusion 118 which may be configured to insertably engage with the vapor duct 106 of the liquid tank 102 and may thereby provide a stabilization connection between the liquid tank 102 and the atomization unit 104.

Alternatively the tank engagement face 117 may further comprises a face recess 120 and the atomizer engagement face 119 further comprises a face protrusion 122 which may be configured to insertably engage with the face recess 120 and may thereby provide a stabilization connection between the liquid tank 102 and the atomization unit 104.

Alternatively the tank engagement face 117 may further comprise a circumferential engagement member 126, and the atomizer engagement face 119 may further comprise a circumferential engagement slot 124. The circumferential engagement slot 124 may be configured to circumferentially envelop the circumferential engagement member 126 and may thereby provide a stabilization connection between the liquid tank 102 and the atomization unit 104.

Alternatively the tank engagement face 117 may further comprise a face cup rim 127 and a face cup 128 with the face cup 128 possibly being inset to the face cup rim 127. The atomizer engagement face 119 may also further comprising a face cup insert 130 and the face cup insert 130 may be configured to insertably engage with the face cup 128 such that the face cup rim 127 may circumferentially envelop the face cup insert 130 of the atomization unit 104 and may thereby provide a stabilization connection between the liquid tank 102 and the atomization unit 104.

Alternatively the liquid tank 102 may further comprise an outer tank wall 132 and the atomization unit 104 further comprises an outer atomizer wall 134 which may further have a connection arm 140. The connection arm 140 may have an engagement member 138. The outer atomizer wall 134 may also have a connection aperture 136. The engagement member 138 may be configured to reversibly engage with the connection aperture 136 such that engagement member 138 could be insertable into the connection aperture 136 and may thereby provide a stabilization connection between the liquid tank 102 and the atomization unit 104. The outer tank wall 132 may be configured to be enveloped by the outer atomizer wall 134, or the outer tank wall 132 may be configured to envelop the outer atomizer wall 134.

Additionally, the connection arm may further comprise a hinge 220, wherein the hinge 220 may be configured to engage with the lower connection 114 on the atomization unit 104 by application of a force onto a lever 222, the lever 222 being movable from a reversibly hinged engagement of the engagement member 138 with the connection aperture 136 to a reversibly unhinged engagement of the engagement member 138 with the connection aperture 136.

Alternative embodiments may further include the atomization unit further comprising an atomization unit cover 142 and a lock interface plate 144. The atomization unit 142 cover may be engageable with the upper filling point 110 and the upper filling point 110 may further have a liquid tank end 145 and an atomization unit end 147. The atomization unit end 147 may be larger than the liquid tank end 145. Further, the atomization unit end 147 of the upper filling point 110 may be configured for insertable retention into the atomization unit cover 142 and the retention plate 146. The retention plate may be mounted between the lock interface plate 144 and the atomization unit cover 142. The atomization unit cover 142 may further have an insert hole 152 and an engagement slot 150. The engagement slot 150 may be elongated and configured such that the insert hole 152 is to one end of the engagement slot 150. The insert hole 150 may be larger than the engagement slot 150. The lock interface plate may have a keyhole 148, wherein the keyhole 148 may be configured to align with the atomization unit end 147 when the liquid tank 102 is engaged and rotated. This may result in the atomization unit end 147 transitioning along the elongated engagement slot 150 until the keyhole 148 and the atomization unit end 147 are aligned. Such alignment may permit the flow of liquid from the liquid tank 102 to the atomization unit 104.

Alternatively the upper filling point 110 of the liquid tank 102 may further comprise a biasing valve 160 which may have a biasing spring 168 and a liquid tank fill plate 172. The lower filling point 116 of the atomization unit 104 may also further comprise a filling plate 164 and a transfer arm 166 and the transfer arm 166 may be configured to engage with the liquid tank fill plate 172 and bias the biasing valve 160 to an open configuration when the upper filling point 110 and the lower filling point 116 are engaged.

Alternatively the liquid tank 102 may further have a removable seal 198 which may be configured for liquid retention inside of the liquid tank 102 and removable prior to joining with the atomization unit 104.

Alternatively the atomization unit 104 may further comprise a mating post 200 which may have an entrapment notch 202. The entrapment notch 202 may be configured to maintain connective communication with an anti-removal plug 206. Further, the anti-removal plug 206 may have a liquid seal member 208 configured to engage with a liquid tank hole 210 of the liquid tank 102 such that separation of the combinable and separable cartridge 100 after union of the atomization unit 104 and the liquid tank 102 would render the liquid tank 102 unusable due the liquid tank hole 210 being in open communication with the external environment and unable to retain the liquid medium.

Alternatively the upper filling point 110 may be covered by a removable upper filling point seal 226 which may be configured to retain liquid internal to the liquid tank 102 and configured for removal prior to engagement with the atomization unit 104.

Other described embodiments may alternatively include an assembly for the vaporization of a liquid medium which may comprise a cartridge 100 which may have an atomization unit 104 and a liquid tank 102 which are unconnected. The atomization unit 104 may further have at least one or possibly more than one a lower filling point 116. The liquid tank 102 may further have at least one and possibly more than one upper filling point 110. The upper filling point 110 and the lower filling point 116 may be configured to reversibly mate together. The reversible mating of the upper filling point 110 and the lower filling point 116 may result in the transfer of a liquid medium from the liquid tank 102 to the atomization unit 104. The atomization unit 104 may further have an atomization chamber 112 and the liquid tank 102 may further have a vapor duct 106. The atomization chamber 112 and the vapor duct 106 may be configured to align when the upper filling point 110 and the lower filling point 116 are reversibly mated such that the vaporized liquid medium may pass through therein. Additionally, the atomization unit 104 may be prefilled with a liquid medium for vaporization.

Other described embodiments may alternatively include a cartridge 100 which may comprise an atomization unit 104 and a liquid tank 102 which may be separate but configured to be joined together. The atomization unit 104 and the liquid tank 102 may each having one or more than one stabilizing connection between them and may be configured to be connected and stabilized by the stabilizing connections. Stabilizing connections are any connection that may provide a stabilizing force between the liquid tank 102 and the atomization unit 104. The atomization unit 104 may have one or more than one upper filling point 110, and the liquid tank 102 may have one or more than one lower filling point 116. The union of the upper filling point 110 and the lower filling point 116 may result in fluid communication between the atomization unit 104 and the liquid tank 102.

Additionally, a method of combining a liquid tank 102 and an atomization unit 104 to form a cartridge 100 may include placing a tank engagement face 117 of the liquid tank 102 adjacent to an atomizer engagement face 119 of the atomization unit 104. Aligning an upper filling point 110 on the tank engagement face 117 of the liquid tank 102 with a lower filling point 116 on the atomizer engagement face 119 of the atomization unit 104 and then connecting the liquid tank 102 with the atomization unit 104.

This method may alternatively and/or additionally include at least one or more than one an upper connection 108 from the liquid tank 102 which may then be engaged with at least one or more than one a lower connection 114 of the atomization unit 104.

This method may alternatively and/or additionally include the atomization protrusion 118 extending from the atomizer engagement face 119 which may then be insertably engaged with a vapor duct 106 of the tank engagement face 117 of the liquid tank 102.

This method may alternatively and/or additionally include a face recess 120 of the tank engagement face 117 which may then be engaged with a face protrusion 122 of the atomizer engagement face 119.

This method may alternatively and/or additionally include a circumferential engagement member 126 of the tank engagement face 117 which may be engaged with a circumferential engagement slot 124 of the atomizer engagement face 119 such that the circumferential engagement slot 124 may circumferentially envelop the circumferential engagement member 126.

This method may alternatively and/or additionally include a face cup rim 127 and a face cup 128 of the tank engagement face 117 which may engage with a face cup insert 130 of the atomizer engagement face 119 and the face cup insert 130 may further then be insertably engaged with the face cup 128 such that the face cup rim 127 may circumferentially envelop the face cup insert 130 of the atomization unit 104.

This method may alternatively and/or additionally include an outer tank wall 132 of the liquid tank 102 which may be engaged with an outer atomizer wall 134 of the atomization unit 104. The outer tank wall 132 may have a connection arm 140 and the connection arm 140 may also have an engagement member 138. The outer atomizer wall 134 may have a connection aperture 136 the engagement member 138 may then be reversibly engaged with the connection aperture 136 such that engagement member 138 may be insertable into the connection aperture 136.

Further, this particular design is configured to have certain portions welded together by use of a wide variety of techniques. Examples of this include, but are not limited to, welding from mechanical movement, welding by external heat source, or welding by electromagnetism. This may include but is not limited to linear vibration, spin, ultrasonic, hot plate, hot bar and impulse, hot gas, extrusion, resistive implant, induction, high frequency (dielectric), infrared, or laser. This may result in a liquid tank 102 and an atomization unit 104 which are the only portions of the cartridge 100 which may be assembled and disassembled by the end user.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention. The above explanation describes only several potential models that may be preferred for this disclosure, which shall not limit the boundaries of this disclosure. Equivalent transformations or configurations based on this disclosure of the various figures and descriptions explained herein are also included in the boundaries of this particular and subsequent disclosure.

Accordingly, it is not intended that the invention be limited except by the appended claims. Insofar as the description above and the accompanying drawings disclose any additional subject matter that is not within the scope of the claims below, the inventions are not dedicated to the public and the right to file one or more applications to claim such additional embodiments are reserved.

What is claimed is:

1. A combinable and separable cartridge comprising: an atomization unit and a liquid tank; the atomization unit having an atomization chamber, at least one or more than one a lower filling point, and an atomizer engagement face; the liquid tank having a vapor duct, at least one or more than one an upper filling point and a tank engagement face; the liquid tank being prefilled with a liquid medium for vaporization; the atomization unit being configured to be prefilled with the liquid medium for vaporization; the upper filling point of the liquid tank and the lower filling point of the atomization unit configured to mate together, wherein the mating of the upper filling point and the lower filling point forms a liquid permeable connection between the atomization unit and the liquid tank such that the liquid medium permeates from the liquid tank to the atomization unit; the liquid tank having at least one or more than one an upper connection and the atomization unit having at least one or more than one a lower connection, the upper connection and the lower connection being configured to reversibly mate together thereby providing stabilization connections between the liquid tank and the atomization unit.

2. An assembly for the vaporization of a liquid medium comprising: a cartridge, wherein the cartridge further comprises an atomization unit and a liquid tank which are configured to be connected; the atomization unit further having at least one or more than one a lower filling point, the liquid tank further having at least one or more than one an upper filling point; the upper filling point and the lower filling point configured to reversibly mate; the reversible mating of the upper filling point and the lower filling point resulting in the transfer of the liquid medium from the liquid tank to the atomization unit; wherein the atomization unit further has an atomization chamber and the liquid tank further has a vapor duct; the atomization chamber and the vapor duct being configured to align when the upper filling point and the lower filling point are reversibly mated such that the vaporized liquid medium may pass through therein; the liquid tank configured for prefilling with the liquid medium for vaporization; the atomization unit further having an atomizer engagement face and the liquid tank further having a tank engagement face; wherein the liquid tank further comprises at least one or more than one an upper connection and the atomization unit further comprises at least one or more than one a lower connection; the upper connection and the lower connection configured to reversibly mate together thereby providing stabilization connections between the liquid tank and the atomization unit.

3. A cartridge comprising: an atomization unit and a liquid tank which are separate and configured to be joined together, the atomization unit and the liquid tank each having a one or more than one stabilizing connection between them and configured to be connected and stabilized by the stabilizing connection and, the atomization unit having a one or more than one upper filling point, and the liquid tank having a one or more than one lower filling point wherein, the union of the upper filling point and the lower filling point results in fluid communication between the atomization unit and the liquid tank; the atomization unit having of atomization chamber and the liquid tank having a vapor duct; the atomization chamber and the vapor duct being configured to align when the upper filling point and the lower filling point are reversibly mated such that a gas phase of a liquid medium may pass through therein; the liquid tank being prefilled with the liquid medium for vaporization; the atomization unit having an atomizer engagement face and the liquid tank having a tank engagement face; the liquid tank having at least one or more than one an upper connection and the atomization unit having at least one or more than one a lower connection, the upper connection and the lower connection configured to reversibly mate together thereby providing stabilization connections between the liquid tank and the atomization unit.

* * * * *